US005439075A

United States Patent [19]

Skalski et al.

[11] Patent Number: 5,439,075

[45] Date of Patent: * Aug. 8, 1995

[54] ELEVATOR ACTIVE SUSPENSION SYSTEM

[75] Inventors: Clement A. Skalski, Avon; John K. Salmon, South Windsor; Boris G. Traktovenko, Avon; Richard L. Hollowell, Amston, all of Conn.

[73] Assignee: Otis Elevator Company, Farmington, Conn.

[ * ] Notice: The portion of the term of this patent subsequent to Jun. 21, 2011 has been disclaimed.

[21] Appl. No.: 208,416

[22] Filed: Mar. 9, 1994

Related U.S. Application Data

[60] Division of Ser. No. 76,501, Jun. 11, 1993, Pat. No. 5,322,144, which is a continuation of Ser. No. 731,292, Jul. 16, 1991, which is a continuation-in-part of Ser. No. 555,130, Jul. 18, 1990.

[51] Int. Cl.[6] ..... B66B 7/02

[52] U.S. Cl. ..... 187/410; 187/278

[58] Field of Search ..... 187/1 R, 73, 95, 100, 187/115, 134, 98, 40, 41, 410, 278

[56] References Cited

U.S. PATENT DOCUMENTS

| | | | |
|---|---|---|---|
| 1,148,450 | 4/1915 | Fuller | 187/109 |
| 3,099,334 | 7/1963 | Tucker | 187/95 |
| 3,601,227 | 8/1971 | Burch | 187/29 R |
| 3,669,222 | 6/1972 | Takamura et al. | 187/95 |
| 3,871,301 | 3/1975 | Kolm et al. | 104/148 SS |
| 3,939,778 | 2/1976 | Ross et al. | 104/148 MS |
| 4,113,064 | 9/1978 | Shigeta et al. | 187/1 R |
| 4,167,296 | 9/1979 | Dendy | 74/5 R |
| 4,215,403 | 7/1980 | Pollard et al. | 364/424 |
| 4,621,833 | 11/1986 | Soltis | 280/707 |
| 4,625,993 | 12/1986 | Williams et al. | 280/707 |
| 4,660,682 | 4/1987 | Luinstra et al. | 187/1 R |
| 4,750,590 | 6/1988 | Otala | 187/95 |
| 4,754,849 | 7/1988 | Ando | 187/95 |
| 4,770,438 | 9/1988 | Sugasawa et al. | 280/707 |
| 4,809,179 | 2/1989 | Klinger et al. | 364/424.05 |
| 4,849,666 | 7/1989 | Hoag | 310/90.5 |

(List continued on next page.)

FOREIGN PATENT DOCUMENTS

| | | | |
|---|---|---|---|
| 0033184 | 8/1981 | European Pat. Off. | B66B 7/04 |
| 0350582 | 1/1990 | European Pat. Off. . | |

(List continued on next page.)

OTHER PUBLICATIONS

NASA TechBriefs, "Flux-Feedback Magnetic-Suspension actuator", Publ. Jul. 1990, pp. 44–45.

NASA Tech. Memor. 100672, "A magnetic Bearing Control Approach using Flux Feedback" by N. Groom, Mar. 1989.

Pop. Science, "Riding on Electrons" by Don Sherman, Sep. 1990, pp. 74–77.

Journal of Dyn. Meas. Sys. Control, "Performance of Magnetic Suspension for High Speed Vehicles Operating over flexible Guideways" by C. A. Skalski, Jun. 1974.

ENESCO Inc., prepared for: Federal Railroad Adminis., "Development of an Inertial Profilometer" by E. L. Brandenburg et al., Nov. 1974.

"Inertial Profilometer as a Rail Surface Measuring Intrument" by T. J. Rudd and E. L. Brandenburg, pp. 1–9.

*Primary Examiner*—Kenneth Noland

*Attorney, Agent, or Firm*—Francis J. Maguire

[57] ABSTRACT

An elevator car vertically guided along a hoistway rail has horizontal motions controlled by means of an actuator wherein horizontal acceleration of the elevator car and relative horizontal displacement between the car and the rail is sensed for controlling such horizontal motions by means of the actuator. Guiding means can be provided in the form of roller clusters at the corners of the car for engaging hoistway rails on opposite sides of the car wherein, for each roller cluster, plural actuators are included with accompanying springs wherein the roller cluster actuators are responsive to the controller for actuating the elevator car horizontally with respect to the hoistway rail. The roller cluster actuators can be electromagnets. Each wheel of the roller cluster can have stop means assocaiated therewith that is operable to limit the extent of movement of the guide wheel in a direction away from the guide rail.

5 Claims, 24 Drawing Sheets

U.S. PATENT DOCUMENTS

| | | | |
|---|---|---|---|
| 4,882,512 | 11/1989 | Andrus | 310/90.5 |
| 4,892,328 | 1/1990 | Kurtzman et al. | 280/707 |
| 4,898,257 | 2/1990 | Brandstadter | 180/9.1 |
| 4,899,852 | 2/1990 | Salmon et al. | 187/1 R |
| 4,901,348 | 2/1990 | Nichols et al. | 370/85.2 |
| 4,909,535 | 3/1990 | Clark et al. | 280/707 |
| 4,912,343 | 3/1990 | Stuart | 310/14 |
| 4,987,571 | 1/1991 | Haymond et al. | 370/85.2 |
| 5,020,639 | 6/1991 | Michel | 187/1 R |
| 5,027,925 | 7/1991 | Kahkipuro et al. | 187/115 |
| 5,086,882 | 2/1992 | Sugahara et al. | 187/410 |
| 5,117,946 | 6/1992 | Traktovenko et al. | 187/95 |
| 5,193,651 | 3/1993 | Shigeta et al. | 187/95 |
| 5,294,757 | 3/1994 | Skalski et al. | 187/115 |
| 5,304,751 | 4/1994 | Skalski et al. | 187/115 |
| 5,308,938 | 5/1994 | Roberts et al. | 187/115 |
| 5,321,217 | 6/1994 | Traktovenko et al. | 187/115 |
| 5,322,144 | 6/1994 | Skalski et al. | 187/115 |

FOREIGN PATENT DOCUMENTS

| | | | |
|---|---|---|---|
| 0367621 | 5/1990 | European Pat. Off. . | |
| 0467673 | 1/1992 | European Pat. Off. | B66B 11/02 |
| 198255 | 4/1907 | Germany . | |
| 6122675 | 11/1980 | Japan | B66B 7/08 |
| 60-15374 | 7/1983 | Japan | B66B 1/06 |
| 60-36279 | 8/1983 | Japan | B66B 7/04 |
| 58-39753 | 9/1983 | Japan | B66B 7/02 |
| 6345768 | 9/1986 | Japan | B66B 13/06 |
| 6387483 | 9/1986 | Japan | B66B 1/06 |
| 1156293 | 12/1987 | Japan | B66B 11/02 |
| 1197294 | 2/1988 | Japan | B66B 7/04 |
| 1288591 | 5/1988 | Japan | B66B 11/08 |
| 2-3891 | 6/1988 | Japan | G08B 17/107 |
| 2127373 | 11/1988 | Japan | B66B 1/26 |
| 2198997 | 1/1989 | Japan | B66B 11/08 |
| 124683 | 10/1989 | Japan . | |
| 3138271 | 10/1989 | Japan | B66B 1/14 |
| 3138280 | 10/1989 | Japan | B66B 7/02 |
| 3-3884 | 1/1991 | Japan | B66B 7/06 |
| 3-3888 | 1/1991 | Japan | B66B 11/02 |
| 3-23185 | 1/1991 | Japan | B66B 11/02 |
| 3-51279 | 3/1991 | Japan | B66B 5/02 |
| 3-51280 | 3/1991 | Japan | B66B 5/02 |
| 3-51281 | 3/1991 | Japan | B66B 5/02 |
| 3-51285 | 3/1991 | Japan | B66B 11/02 |
| 3-88687 | 4/1991 | Japan | B66B 7/04 |
| 3-88690 | 4/1991 | Japan | B66B 11/02 |
| 3115076 | 5/1991 | Japan | B66B 1/06 |
| 3124683 | 10/1991 | Japan | B66B 7/02 |
| 5-24768 | 2/1993 | Japan | B66B 7/04 |
| 1030728 | 5/1966 | United Kingdom . | |
| 2181275 | 4/1987 | United Kingdom . | |
| 2238404 | 5/1991 | United Kingdom | B66B 7/02 |
| 2262166 | 9/1993 | United Kingdom . | |

FIG.24
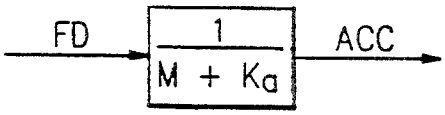
FIG.25
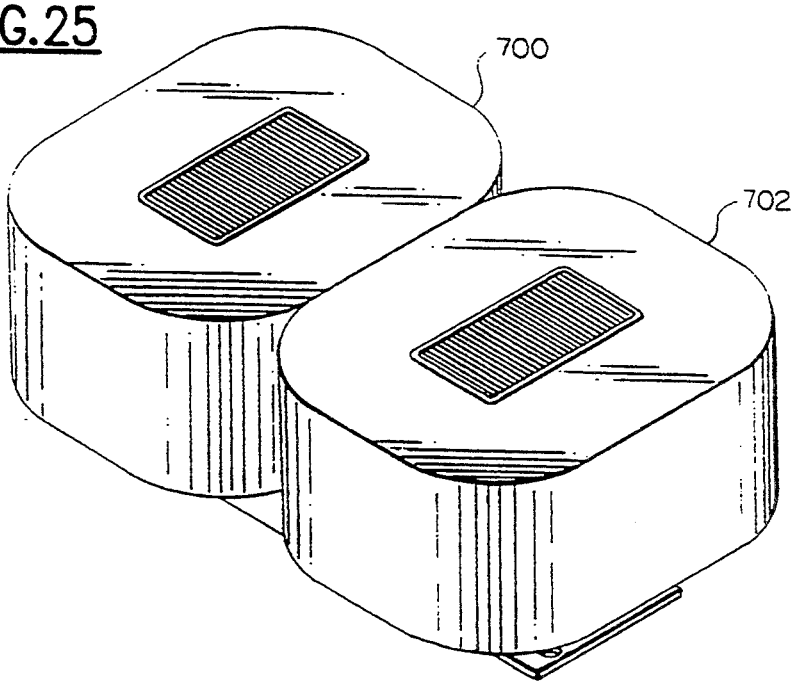
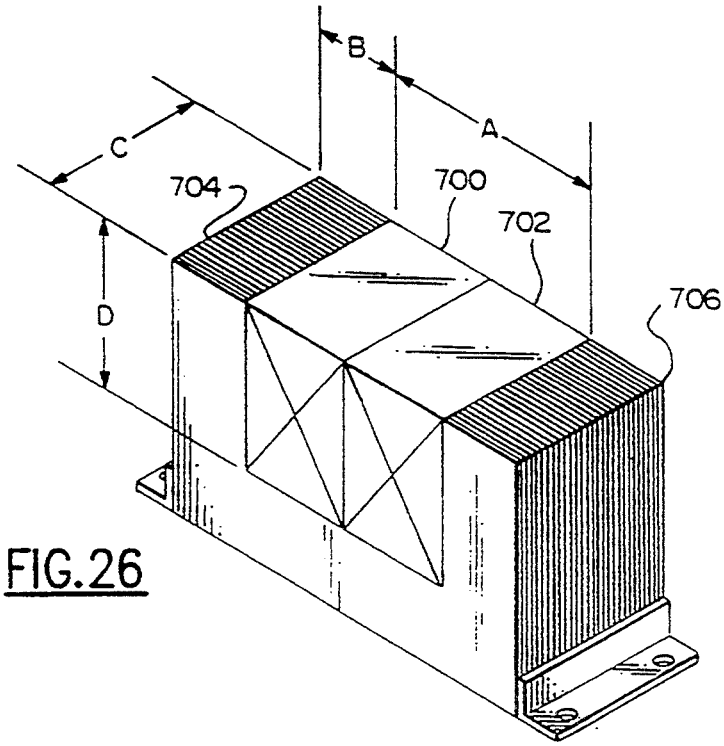
FIG.26

FIG. 44
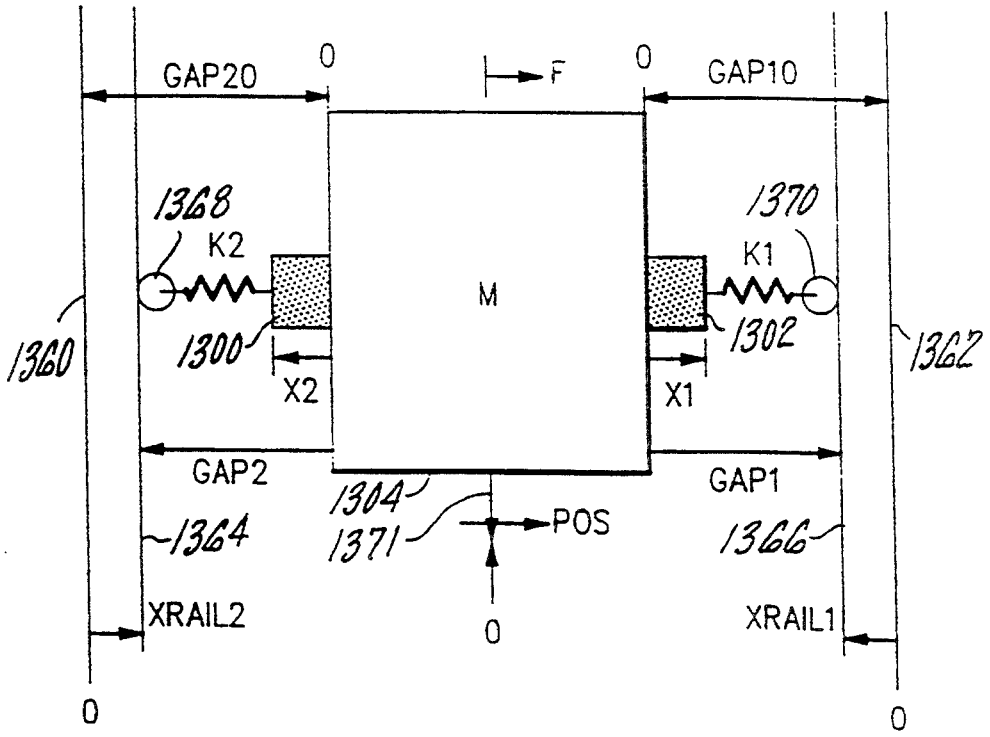
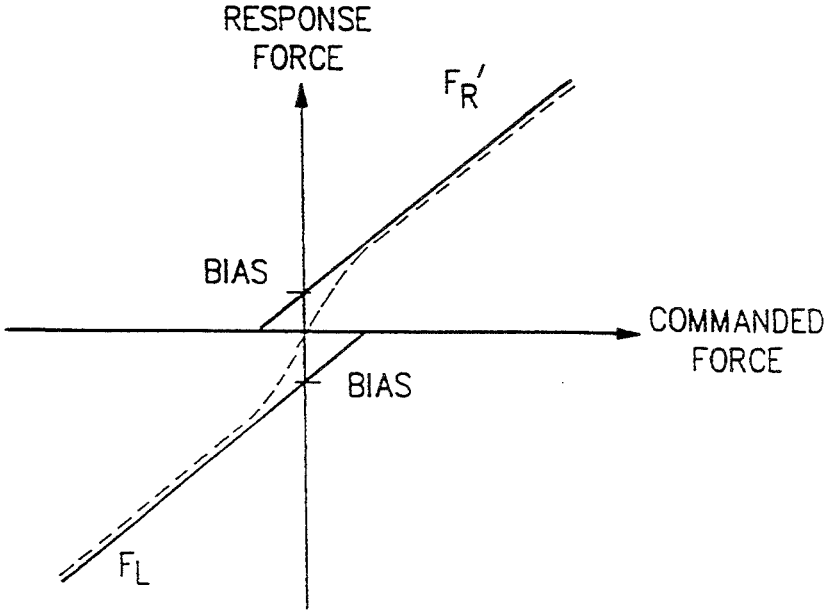
FIG. 41

| FIG. 42A | FIG. 42B |
|---|---|

ELEVATOR ACTIVE SUSPENSION SYSTEM

This is a divisional of application Ser. No. 08/076,501 filed Jun. 11, 1993, now U.S. Pat. No. 5,322,144 is a continuation of application Ser. No. 07/731,292 filed Jul. 16, 1991 which is a continuation-in-part of application Ser. No. 07/555,130 filed on Jul. 18, 1990.

RELATED APPLICATION

This application discloses subject matter which may be disclosed and claimed in commonly owned, applications U.S. Ser. No. 07/731,291, now U.S. Pat. No. 5,321,217entitled Apparatus and method for Controlling an Elevator Horizontal Suspension U.S. Ser. No. 07/731,308, now U.S. Pat. No. 5,294,757, U.S. Ser. No. 07/555,140 entitled "Y-Shape Section for Elevator Guide Rail" now abandoned U.S. Ser. No. 08/050,742 entitled "Active Control of Elevator Pendulum Car" now U.S. Pat. No. 5,400,872, and U.S. Ser. No. 07/555,132, now U.S. Pat. No. 5,308,938, entitled "Elevator Active Suspension System" U.S. Pat. No. 5,304,751 entitled "Elevator horizontal Suspensions and Controls", and U.S. Pat. No. 5,322,144 entitled "Active Control of Elevator Platform" .

1. Technical Field

This invention relates to elevators and, more particularly, to providing a smooth ride for an elevator passenger platform.

2. Background Art

In a non-pendulum cab disclosure, U.S. Pat. No. 4,754,849, Hiroshi Ando shows electromagnets disposed outside the car symmetrically about guide rails in a control system using opposing forces from the electromagnets to keep the car steady using the rails as the necessary ferromagnetic mass but, rather than using the rails as a straight reference line, instead using a cable stretched between the top and bottom of the hoistway. The position of the car with respect to the cable is controlled using detectors in a closed loop control system. There is serious question as to whether such a cable can be successfully used as a reliable guide of straightness. Moreover, the Ando disclosure requires the use of a large number (twelve) of electromagnets with separate control and power circuits. Furthermore, the use of guide rails such as are disclosed by Ando will require fairly massive coils in order to generate the large amount of flux density required, given the (i) not insignificant force required to move the weight of the elevator car, (ii) the necessarily small utilizable surface area on the rail, and (iii) the relatively large airgap required as compared to the rail thickness.

In another non-pendulum cab disclosure, U.S. Pat. No. 4,750,590, Matti Otala discloses what appears to be an essentially open loop control system with solenoid actuated guide shoes that uses the concept of memorizing the out-of-straightness of the guide rails for storage in a computer memory and then sensing the position of the car in the hoistway for the purpose of recalling the corresponding information from memory and correcting the guide rail shoe positions accordingly. An acceleration sensor is mentioned in claim 6 but does not appear to be otherwise disclosed as to its purpose in the specification or drawing. Perhaps it is used to determine the acceleration of the car in the hoistway. Such an acceleration signal would presumably be needed to determine which data point to retrieve from memory as suggested in claim 2. Otala's approach suffers from the problem of changes in the out-of-straightness before a correction run can be effected and the accuracy with which the stored information can be made to conform to the car's actual position.

A mounting arrangement for a pendulum or hung cab is shown in U.S. Pat. 4,113,064 by Shigeta et al wherein the cab is suspended within and from the top of an outer car framework by a plurality of rods connected to the bottom of the cab. A plurality of stabilizing stoppers are shown interposed between the underside of the hung cab and the floor of the car frame. Each stopper comprises a cylinder extending downward from the underside of the hung cab surrounding a rubber torus placed on an upright rod extending from the floor of the car frame. Clearance between the cylinder and the hung cab is sufficient to permit movement but insufficient to allow the hung cab to strike the car frame. Another embodiment comprising "bolster" means having ball bearings permits movement in any direction of the horizontal plane.

Another approach is disclosed by Luinstra et al in U.S. Pat. No. 4,660,682 wherein a pair of parallel rails are arranged horizontally in a parallelogram between the suspended cab and car frame with followers arranged to roll or slide on the rails in such a way that the hung cab can move in any horizontal direction relative to the car frame.

Both of the last two pendulum or supported cab approaches employ passive restraints on movement which by nature are reactive rather than active.

DISCLOSURE OF INVENTION

An object of the present invention is to provide an active control for an elevator platform, e.g., for a car or, alternatively, for a pendulum cab hung from a frame or a cab supported within a frame.

According to the present invention a platform, e.g., a suspended elevator car or, alternatively, a cab hung or supported within a frame undergoing movements in moving up and down an elevator hoistway is controlled with respect to a selected parameter by a plurality of actuators in a closed loop control system responsive to a plurality of sensors for detecting the selected or another, related parameter. Such parameters may include position, velocity, acceleration, vibration or other similar parameters, although acceleration is preferred.

In further accord with the present invention, the actuators may be arranged, for a conventional car embodiment, so as to counteract horizontal translational forces acting on the car moving in the hoistway or, for nonconventional hung or supported cab embodiments, arranged to counteract horizontal forces acting on the hung or supported cab moving in the frame as the frame moves in the hoistway. If such a concept is utilized in a conventional car application, it would require, without limitation, only four active actuators near the bottom of the car. Four conventional or passive guides might additionally be used near the top of the car. Such an arrangement might advantageously employ, e.g. but not limited thereto, a nonconventional rail shape, e.g., a shape first suggested for other purposes by Charles R. Otis in U.S. Pat. No. 134,698 (which issued on Jan. 7, 1873). If such a concept is utilized in a pendulum or supported car application it similarly might require, without limitation, only four actuators using a novel active actuator arrangement on or near the bottom of the cab and, also without limitation, using conventional rails for guiding the frame.

In still further accord with the present invention, the actuators may be arranged so as to counteract rotational forces acting about vertical on the conventional car in a hoistway or a cab hung from or supported on a frame. Furthermore, and without limitation, if such a concept is utilized for controlling a conventional car in a hoistway it still would only require four actuators using the same novel rail shape for active control. If such a concept is utilized in a pendulum or supported cab application it similarly still would require only four actuators using a novel active actuator arrangement and, without limitation, using conventional rails for guiding the frame.

In still further accord with the present invention, the actuators may be arranged so as to counteract rotational forces acting on a conventional car, or on a cab hung from or supported on a frame, about one or more axes in a horizontal plane. Such axes may but need not be defined for purposes of control as orthogonal axes in such a horizontal plane and which may be parallel to the hoistway walls. If such a concept is implemented for a non-pendulum car (in conjunction with control of horizontal translations and vertical rotations) it need not but may use only eight actuators using a novel rail shape for active control. If such a concept is implemented for a pendulum or frame-supported cab (in conjunction with control of horizontal translations and vertical rotations) it may but need not utilize only eight actuators using four on the top of the cab and four on the bottom.

In accordance still further with the present invention, the actuators may be of the electromagnetic type.

In further accord with the present invention, the actuators may be electromechanical, e.g., solenoid actuated wheels.

In further accord with the present invention, a preferred embodiment utilizes four electromagnetic actuators each operating along an axis which, for a non-pendulum or non-frame-supported car embodiment, is disposed for imparting forces at an angle of forty-five degrees to a hoistway wall, e.g., opposite hoistway-railed walls and, for the hung cab embodiment, is disposed for imparting forces along axes at an angle of forty-five degrees to the planes of the hung or supported cab walls.

The present invention teaches, among other things, that for a car guided by rails mounted on hoistway walls, that Ando's twelve electromagnets for controlling horizontal translations of an elevator car can be replaced by a lesser number of actuators. According to a preferred embodiment of the present invention, four actuators are sufficient for controlling such translational forces in the horizontal plane. Moreover, as a further teaching, the same four actuators may be used to control rotational forces about vertical. For a non-pendulum cab embodiment, although conventional-style rails may be used, a new rail configuration may be advantageously applied in an active system and four actuators may be well-disposed for controlling translational forces in the horizontal plane. Moreover, as a further teaching, the same four actuators may be used to control rotational forces about vertical. Furthermore, the same teachings may be extended for application to a cab hung or supported in a car frame. In such a case, four well-disposed actuators are similarly sufficient for controlling translational forces in the horizontal plane. And also similarly, as a further teaching, the same four actuators may be used to control rotational forces about vertical.

These approaches have the added advantage of greatly simplifying the design. Moreover, there is then no need to use Ando's cable which may be subject to out-of-straightness forces due to many factors such as building sway, expansion and contraction due to temperature changes, vibrations due to air currents in the hoistway and other causes. Such a construct can be replaced, according to a preferred embodiment of the present invention by accelerometers used to provide signals which can be indicative of position in a closed loop control system.

Although we teach that a position control system based on an accelerometer output is a superior approach, we also recognize that drift is associated with accelerometers which we teach may be corrected, preferably based on a slow regulating loop to control the average car or cab position with respect to a fixed referent.

Thus, in further accord with the present invention, a preferred embodiment of the present invention comprises a relatively fast, simple, analog control loop responsive to accelerometers with one or more, relatively slower, but more accurate, digital control loops responsive to position or acceleration sensors or to both.

As previously suggested, at least for pendulum cabs, the passive restraints employed by Shigeta et al and Luinstra et al are not as effective as the present invention in that they do not actively counteract the undesirable translational forces to which the cab is subjected and thus do not provide as smooth a ride for the passenger as that provided by the present invention. Furthermore, they do not actively counteract the undesirable rotational forces to which the cab is subjected and thus similarly fail to provide as smooth a ride for the passenger as that provided by the present invention. And certainly they do not even consider restraints or active countermeasures of any kind with respect to rotational axes other than vertical, as taught herein.

In the co-pending applications cited at the beginning of the specification, several active suspension inventions are disclosed which describe embodiments of those inventions which include separate, single-axis controls such as disclosed herein in connection with FIG. 18, and which applications also may describe combined, multi-axis control channels. Since single-axis control embodiments may be used in practicing the presently claimed invention, we hereby incorporate those documents by reference as alternate embodiments. It should be understood that the separate, single-axis controls disclosed here and in the other documents are advantageous for simplicity of design and for the advantage of being able to electronically decouple the various control axes. It will be noted, however, that the approach disclosed herein requires a minimum of four channels of electronics but avoids the necessity to purchase six electromagnets.

These and other objects, features and advantages of the present invention will become more apparent in light of the following detailed description of a best mode embodiment thereof, as illustrated in the accompanying drawings.

BRIEF DESCRIPTION OF THE DRAWINGS

FIG. 24 presents FIG. 18 in simplified form to show the concept of synthesizing platform mass by means of an actuator in a simple manner, according to the present invention;

FIG. 25 shows a pair of coils for use with a U-shaped core such as shown in FIG. 26, according to the present invention;

FIG. 26 shows a U-shaped core for use with the coils of FIG. 25;

FIG. 41 is a plot of a biasing technique for controlling a pair of opposite electromagnets wherein, for example, the force command for the righthand active guide of FIG. 40 is biased in a positive direction and the force command for the lefthand guide is biased in a negative direction to provide a composite response that avoids abrupt switching between the pair;

FIG. 43 is a composite overview of FIG. 43*a* and 43*b* and is control scheme for a pair of active guides such as are shown in FIG. 40 including control of both the small actuators and the large actuators and including a steering arrangement for the large actuators;

FIG. 44 is an illustration of some of the parameters illustrated in the control scheme of FIG. 43;

BEST MODE FOR CARRYING OUT THE INVENTION

Figure 1:
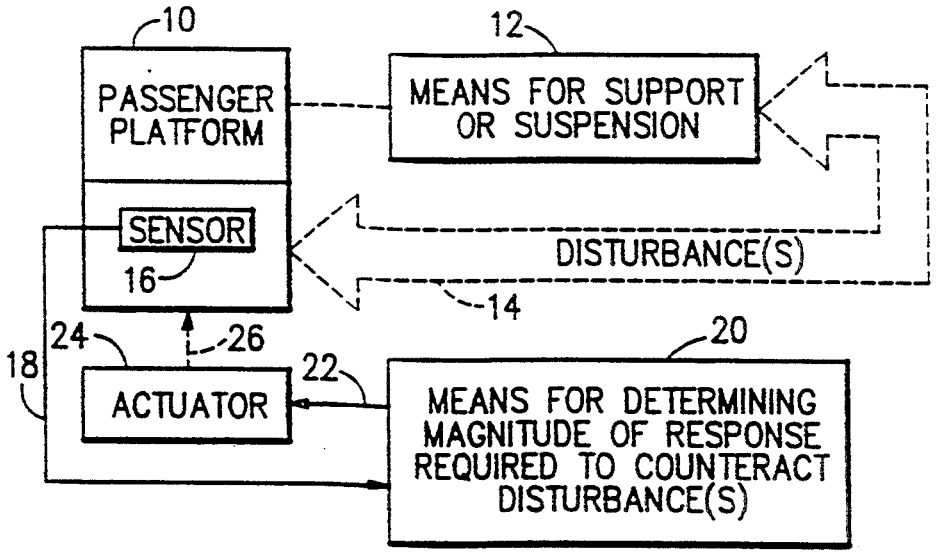
FIG. 1 is a block diagram of an active control system for an elevator car or cab, according to the present invention.

In FIG. 1, a passenger platform 10 for an elevator car or cab is suspended or supported by means 12. As used herein, "cab" refers to a passenger platform suspended or supported within an outer frame (not shown in FIG. 1). "Car" refers to a passenger platform that is not supported within a frame or, alternatively, to a frame for a suspended or supported cab platform (sometimes referred to as a "car frame"). Several examples of the use of each term are: (i) a car suspended by a cable laid over a rotating sheave, (ii) a cab suspended by a cable, rod or rods within a car frame, (iii) a car slidably supported on platform mounted on a hydraulically operated piston, (iv) a cab slidably supported on a car frame, etc. In all cases, the elevator car or car frame is moved up and down in an elevator hoistway (not shown in FIG. 1) guided by means such as vertical rails (not shown) attached to the hoistway walls.

According to the present invention, one or more disturbances 14 (such as an air current in the hoistway acting on the car or car frame, a bumpy ride disturbance transmitted to the car or cab as a result of an out-of-straightness condition in a section of rail, etc.) may be sensed by a sensor 16 disposed in or on the car or cab platform 10. The sensor 16 typically senses an effect of the disturbance 14 for providing a signal having a magnitude indicative of the magnitude of the effect on a line 18. Means 20 is responsive to the signal provided on line 18 for determining the magnitude of the response required to counteract the sensed effect of the disturbance and for providing a signal on a line 22 for commanding an actuator 24 to actuate the platform 10 as indicated by an actuation signal on a line 26. The actuator 24 may be disposed, without limitation, between the car or car frame and the hoistway or may be disposed between the car frame and the cab for imparting forces therebetween in response to the control signal on line 22.

A plurality of sensors similar to sensor 14 may be disposed to be responsive to one or more selected parameters indicative of translational and rotational movements of the car or cab which cause it to deviate from staying perfectly centered on an imaginary vertical line through the center of the hoistway. Such sensors may be responsive to any one or any number of selected parameters such as the position of the car or cab with respect to the hoistway, the translational accelerations experienced by the car or cab, etc. According to a preferred embodiment of the present invention, acceleration is sensed. Such sensors may provide one or more sensed signals to the means 20 or another similar means in order to complete a closed loop for purposes of automatic feedback control, according to the present invention.

As suggested above, one way to view a preferred embodiment of the invention is to think of the control system as causing the elevator car's vertical centerline (or elevator frame-suspended or frame-supported cab's vertical centerline) to remain coincident with an imaginary reference line up the center of the hoistway, without the suspended car or cab's centerline departing from the hoistway reference centerline or without the car or cab rotating about the coincident centerlines.

Figure 2:
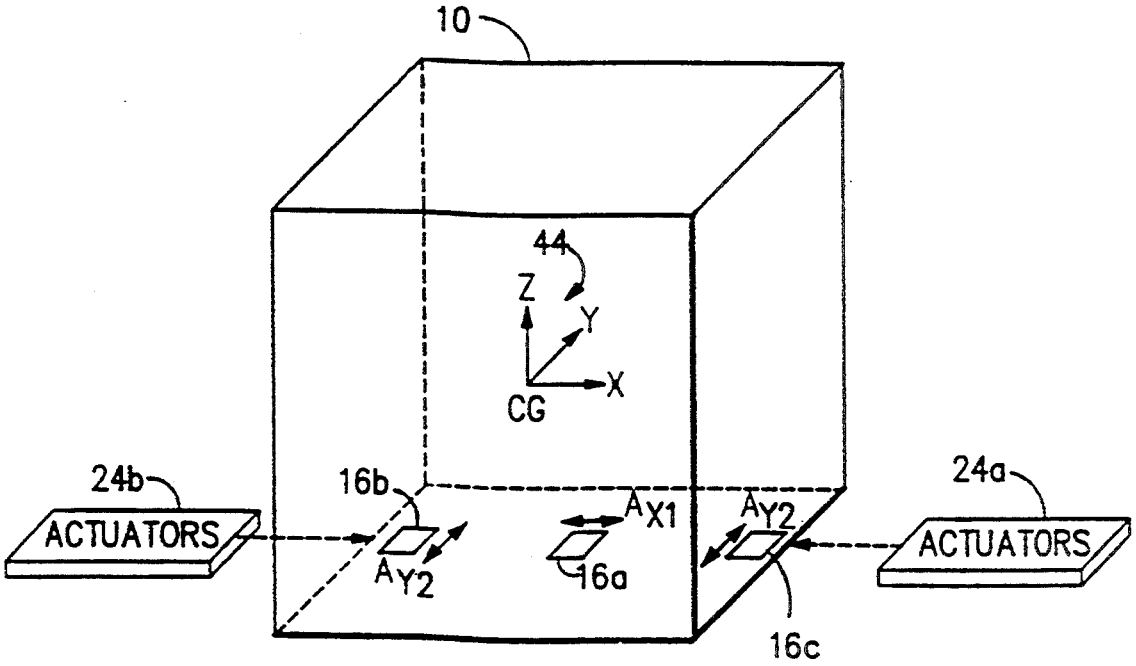
FIG. 2 is an illustration of an elevator car or cab, with a coordinate system shown, according to the present invention.

FIG. 2 illustrates car or cab mounted accelerometers 16*a*, 16*b*, 16*c* which together serve as an example of a sensor arrangement that may be used to sense horizontal accelerations manifesting small horizontal translations causing deviations of the car or cab's centerline from the hoistway's centerline and, without necessarily limiting the foregoing, by further sensing accelerations manifesting small rotations of the car or cab about the hoistway centerline. Selective use of one or more groups of actuators, e.g., actuator groups 24*a*, 24*b*, permits the exertion of forces to maintain the desired coincidence of the car or cab and hoistway centerlines and, if desired, with no rotation about vertical. Although two groups of actuators are shown near the bottom of the car or cab, it should be understood that such are shown to indicate actuators acting from any position or in any grouping, i.e., other groupings at other positions are encompassed by the present invention. The fact that the actuators are shown detached from the platform in no way excludes actuators attached to the platform.

Figure 3:
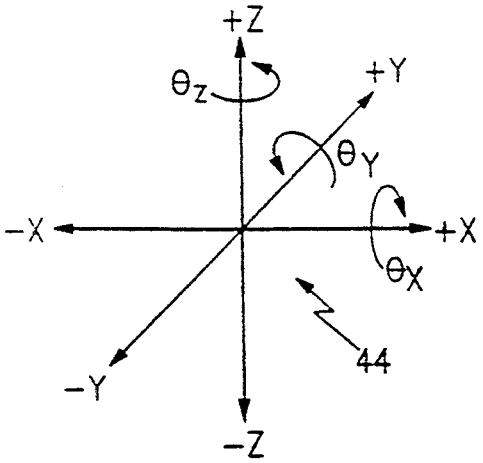
FIG. 3 shows the coordinate system of FIG. 2 in more detail, according to the present invention.

An arbitrary three dimensional coordinate system illustration 44 in FIG. 2 has its x-z plane in the paper and should be thought of as having its origin in the center of gravity of the car or cab 10 and having its minus y-axis pointing up perpendicular to the paper toward the reader. The coordinate system 44 of FIG. 2 is illustrated in more detail in FIG. 3. There, it will be observed that in addition to rotations about the vertical z-axis, there may be rotations about the x and y-axes which may be controlled, if desired. Although such is possible, at least in some cases, the present invention only addresses rotations about vertical.

It will be further observed that the accelerometers cannot be positioned at the center of gravity as would be desired. Without excluding other positions, the floor of the passenger compartment is illustrated here without limitation as an acceptable compromise. It will be observed still further from the locations of the accelerometers that translational accelerations along the x-axis can be sensed by accelerometer 16a while those along the y-axis can be sensed by accelerometers 16*b*, 16*c*. A miscomparison of the outputs of the two x-sensitive accelerometers may, but need not be used to, indicate a rotation about the z-axis. A clockwise or counterclockwise rotation will be indicated depending upon which x-accelerometer 48 or 52 provides the larger magnitude sensed signal. The magnitude of the difference is indicative of the magnitude of the angle of rotation from a reference position.

Although guide rails are not illustrated, such would typically be situated oppositely on two of the four hoistway walls. Such may, for a car example, serve as ferromagnetic masses for use by the actuators 24*a*, 24*b* should the actuator be of the electromagnetic type. In that case, the actuators can be attached near the bottom of the platform 10 for producing magnetic flux for interaction across airgaps with the rails. Or, electromechanical, i.e., contact-type active actuators, to be disclosed below, can be employed. Conventional, passive-type wheel guides can be used at opposite sides at the top of the car to lend additional stability without adding the need for additional active control systems as required by Ando, for example.

In a suspended cab example, electromagnetic, contactless-type actuators 24*a*, 24*b* can be attached to the underside of the cab with suitable ferromagnetic reaction plates erected on the floor of the car frame for providing a path for magnetic flux provided by the actuators. In that case, there would be no need for additional passive guides at the top of the cab.

In a supported car or cab example using a horizontally sliding platform for support, for example as shown in U.S. Pat. No. 4,660,682 to Luinstra et al, but mounted on a hydraulic piston or within a suspended car frame (as shown by Luinstra et al), electromagnetic, contactless-type actuators 24*a*, 24*b* can be attached to the underside of the sliding platform with suitable ferromagnetic reaction plates erected under the sliding platform on a nonsliding horizontal platform mounted on the top of the piston or, for a supported cab, on the floor of the car frame, for providing a path for magnetic flux provided by the actuators.

Figure 14:
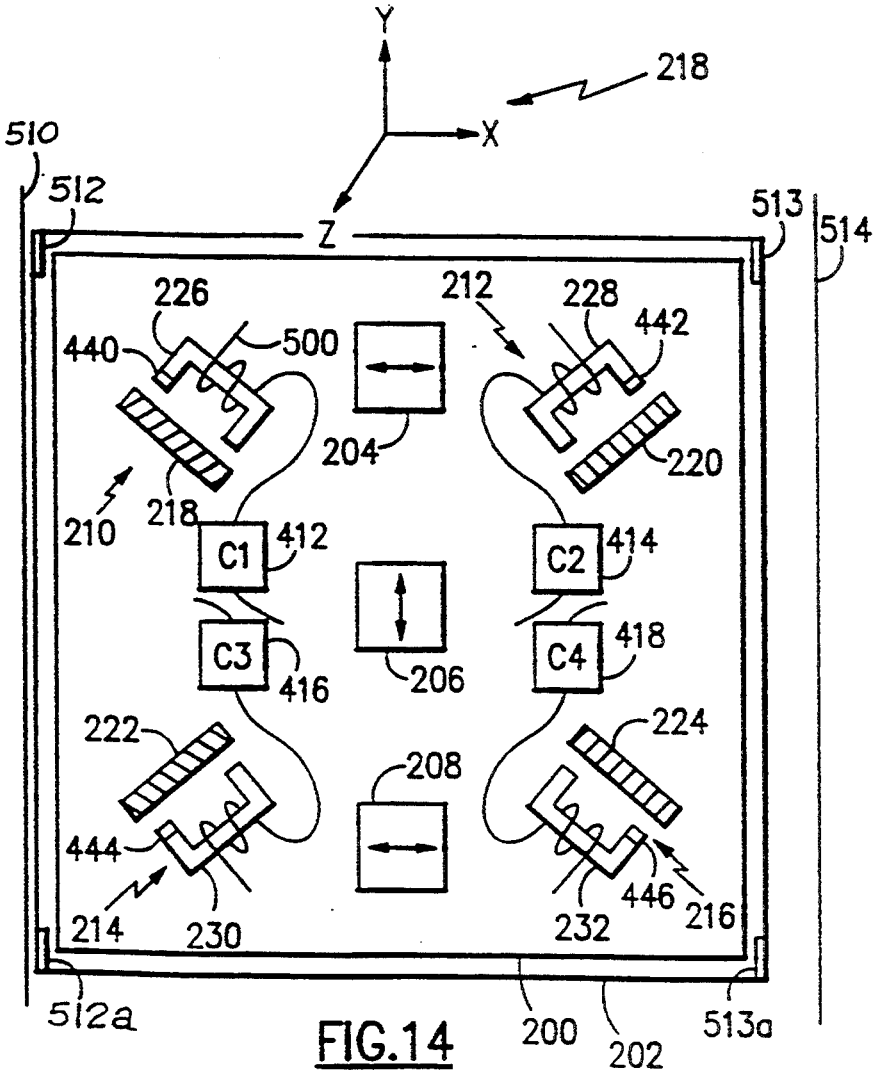
FIG. 14 is an illustration of an elevator cab platform in plan view having an active control using a novel actuator arrangement, according to the present invention.

It should be understood from the foregoing that a preferred embodiment of present invention may be utilized for increasing ride comfort in an elevator car or cab. The preferred embodiment of the present invention will be described first for a cab and then for a car. It will become apparent that the same approach is used for both the car and cab, differing in detail only to the extent necessary to account for the fact that the actuators for a car act against a rail on a hoistway wall while the actuators for a cab act on a frame as shown in FIG. 14.

There, a floor 200 of the passenger platform (cab) and a bottom of a frame 202 are superimposed and are presented in a plan view which shows the two substantially in registration at rest. For descriptive purposes and not by way of limitation, if one assumes a rectangular or, for even greater simplicity, a square layout for the cab floor and frame bottom, one can visualize a pair of reaction planes perpendicular to the cab floor 200 and frame bottom 202 which intersect one another along a vertical cab centerline which perpendicularly intersects the center of the square. The reaction planes may or may not intersect the floor and bottom along the bottom's (and floor's) diagonals.

As mentioned, one way to view the preferred embodiment of the invention is to think of the control system as causing the elevator cab's centerline to remain coincident with an imaginary reference line up the center of the hoistway without the suspended cab rotating about the coincident cab and hoistway centerlines.

It does this by the use of cab-mounted accelerometers 204, 206, 208 which together are used to sense accelerations manifesting small translational deviations of the cab's centerline from the hoistway's centerline and by further sensing accelerations manifesting small rotations of the cab about the hoistway centerline and by the selective use of actuators 210, 212, 214, 216 exerting forces perpendicular to the reaction planes to maintain the centerlines desired coincidence with no rotation. A three dimensional coordinate system illustration 218 in FIG. 14 has its x-y plane in the paper and should be thought of as having its origin in the center of the square 200, 202 and having its z-axis pointing up perpendicular to the paper toward the reader. It will be observed from the locations of the accelerometers that translational accelerations along the y-axis can be sensed by accelerometer 206 while those along the x-axis can be sensed by either accelerometer 204 or 208. A miscomparison of the outputs of the two x-sensitive accelerometers will indicate a rotation about the z-axis. A clockwise or counterclockwise rotation will be indicated depending upon which x-accelerometer 204 or 208 provides the larger magnitude sensed signal. I.e., the magnitude and sign of the miscomparison is indicative of the magnitude and direction of the angle of rotation.

Ferromagnetic reaction plates 218, 220, 222, 224 of the same size can be erected symmetrically about the center of the frame's floor near each corner along the diagonals so as to lie in the reaction planes. Four electromagnet cores 226, 228, 230, 232 with coils may be attached to the bottom surface of a suspended or supported platform so that each faces one of the reaction plates. Attractive forces generated by the control system by means of the four electromagnet core-coils are exerted in such a way as to separate or bring closer the core-coils from their associated reaction plates.

The positioning of the core-coils with respect to the reaction planes can of course vary. As shown, for example in FIG. 14, electromagnet core-coils situated along the same diagonal at opposite corners, i.e., the pair 226, 232 or the pair 228, 230 are arranged to exert attractive forces on opposite sides of the reaction plane so that a pair of electromagnets associated with one of the reaction planes act in concert to counteract clockwise rotational forces while the other pair counteracts counterclockwise rotational forces. Electromagnetic actuators acting along axes intersecting the same cab wall, e.g., 230, 232 or 226, 228 may be situated in between that wall and their respective reaction plates so they may co-act to offset translational forces.

However, it should be understood that the electromagnet cores and coils could be transposed in FIG. 14, i.e., the cores could all be situated on opposite sides of the reaction plates than the sides shown with the only change being that all control actions would be reversed. Or, the core-coil pairs shown on opposite sides of the same diagonal for co-acting against a particular direction of rotational disturbing forces can instead be associated with adjacent corners of the cab such that the actuators are arranged, with respect to the diagonals, on the same side thereof, so that the diagonally associated pairs are no longer co-acting. In that case, the equations would of course have to be rewritten but the same principles as disclosed herein would apply in general.

It should also be understood that the reaction plates could be mounted on the underside of the cab with the electromagnet core-coils mounted on the floor of the frame.

It should also be understood that an "X" or diagonal concept with "reaction planes" has been introduced as a teaching tool, is merely a conceptual aid for describing a preferred cab embodiment and need not necessarily be embodied or even conceptually applicable in all applications of the invention. Such an "X" or diagonal layout is disclosed in a co-owned, passive, pendulum cab application in U.S. Pat. No. 4,899,852 to Salmon et al.

Even if conceptually applicable in whole or in part to other embodiments, it should be understood that the orientation of the "X" need not be from corner to corner as described but could lie in any convenient orientation. Similarly, the actuators and reaction plates need not be located between the bottom of the cab and the floor of the frame. Nor need they all necessarily be at the same level, although such an arrangement could cause unneeded complexity. Needless to say, the invention is not restricted to the use of four actuators, as three, four, five or more could be used. Four has been selected as a convenient number that fits well with the symmetry of a typical elevator car and hoistway.

For the car embodiment to be disclosed in more detail below, FIGS. 4–7 and FIGS. 9–13 show various embodiments of a novel, plural-bladed rail configuration, in each case according to the present invention for use with active control systems, which plural-bladed rails are all distinguished from the prior art single-bladed rail, shown in FIG. 8, used in at least one prior art active system. (See U.S. Pat. No. 4,754,849 to Ando).

In FIGS. 4–7 and FIGS. 9–13, more than one "blade" is used in each case to interface with two or more corresponding actuators. In FIG. 8, in contrast, a single blade 40 is used by all three actuators 42, 44, 46. It should be understood that for all of the plural-bladed rails shown below, the associated actuators may be disposed differently than in the exact manner illustrated.

Figure 4:
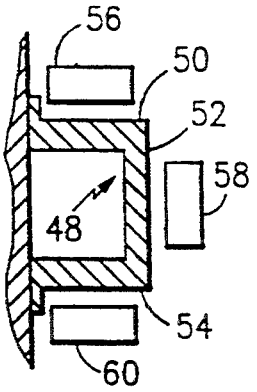
FIGS. 4–7 show various active rail configurations, according to the present invention.

In FIG. 4, a rectangular shape rail 48 has three blades 50, 52, 54 for serving as ferromagnetic paths or masses for three separate electromagnetic actuators 56, 58, 60 respectively. As an example of how an associated actuator could be disposed differently than illustrated, the actuator 58 could be positioned between the blade 52 and the hoistway wall instead, to save space and make the arrangement more compact.

Figure 5:
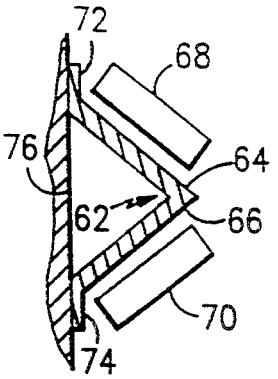

In FIG. 5, a two-bladed rail 62, is shown having a V-shape comprising a blade 64 and a blade 66. A triangle-shaped configuration was previously disclosed for a passive system by Charles R. Otis in U.S. Pat. No. 134,698. However, according to the present invention, plural blades may be used in an active system, e.g., the blade 64 serves as a ferromagnetic mass for electromagnetic actuator 68 while blade 66 serves a similar function for actuator 70. It should be understood that the rail 62 may have footings 72, 74 for easily attaching the rail to a hoistway-way wall 76. Or, the rail 62 may be formed in a full triangular cross-section with or without footings (not shown). Similarly, referring back to FIG. 4, the three-bladed embodiment may comprise a four-blade box-shaped rail without footings. As another example of how an associated actuator could be disposed differently than illustrated, the actuator 70 could be positioned opposite actuator 68, on the other side of blade 64 and blade 66 could be used as an engagement projection for a safety brake (not shown).

Figure 6:
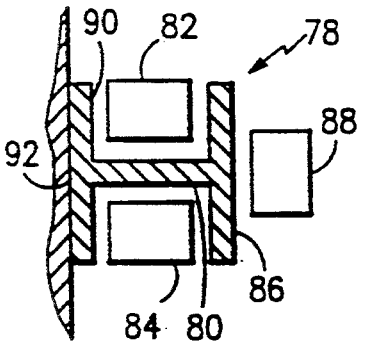

In FIG. 6, an I-beam 78 approach is used. A blade 80 is used by a pair of opposed electromagnetic actuators 82, 84 while a second blade 86 is used by a third actuator 88. A third blade 90 is not used as a ferromagnetic mass or path by any actuator but may be used to attach the other two blades to a hoistway wall 92.

Figure 7:
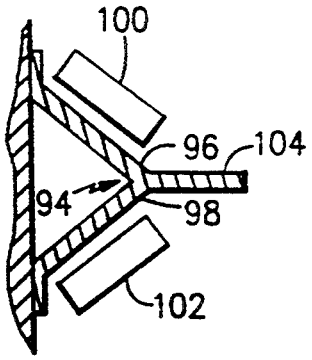
Figure 8:
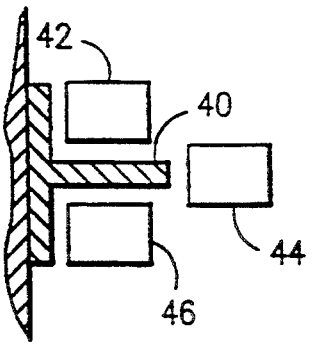
FIG.8 PRIOR ART
FIG. 8 shows a prior art active rail configuration.

FIG. 7 illustrates a variation of the two-bladed V-shaped rail 62 of FIG. 5. Rail 94 comprises a pair of blades 96, 98 for interfacing with respective actuators 100, 102. The rail also includes a projecting blade 104 which may be used as a convenient handle, upon which to engage a safety brake (not shown).

Figure 9:
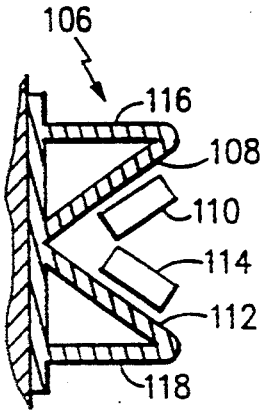
FIGS. 9–13 show various active rail configurations, according to the present invention.

FIG. 9 shows an inverted V-shaped rail 106 having a blade 108 for interacting with an electromagnetic coil 110 and a blade 112 for a coil 114. Blades 116, 118 provide structural strength.

Figure 10:
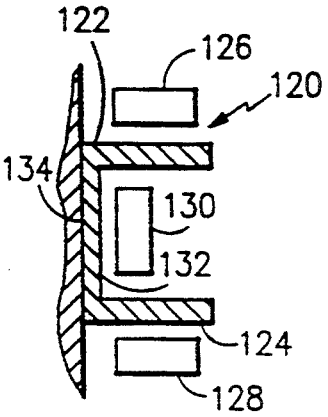

FIG. 10 shows a C-shaped rail 120 having a blade 122 and a blade 124 for providing a ferromagnetic path for coils 126, 128, respectively. A coil 130 uses a blade 132 as its ferromagnetic mass. Blade 132 may also be used to attach rail 120 to a hoistway wall 134.

Figure 11:
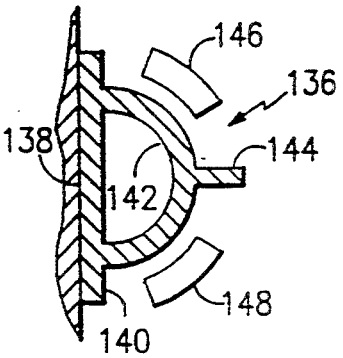

FIG. 11 illustrates a rail 136 mounted on a hoistway wall using a facing pedestal 140. The rail 136 comprises a curved section 142 which, in effect, comprises two "blades" one on either side of a projecting blade 144 for safety brake purposes. One side of the curved section is used for interacting with a coil 146 while the other is used for interacting with a coil 148.

Figure 12:
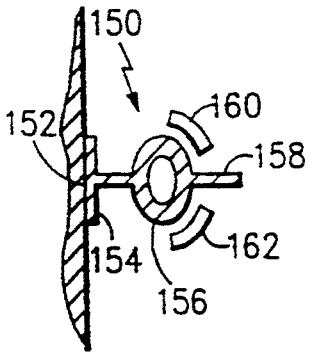

FIG. 12 is an illustration of a rail 150 attached to a hoistway rail 152 by means of a footing 154. The active part of the rail 150 comprises a circular rail 156 which in effect comprises two half-circles on either side of a projection 158. Coils 160, 162 used the respective halves of the circle 156 as ferromagnetic masses. Thus, rail 150 is, in effect, a two-bladed rail.

Figure 13:
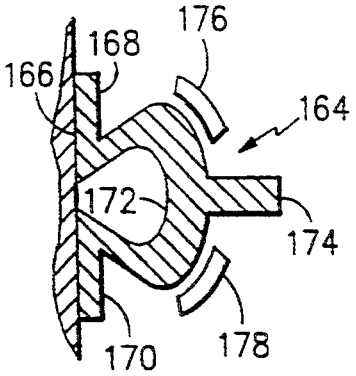

FIG. 13 is an illustration of a rail 164 mounted on a hoistway wall 166 by means of footings 168, 170. A curved section 172 is, in effect, split into two sections on either side of a projection 174. Each section is utilized by an actuator, i.e., actuator 176, 178 respectively. The rail 164 is similar in concept to rail 136 FIG. 11 except it has an "omega" shape rather than a "D" shape.

The rail 94 in FIG. 7 is the preferred embodiment for enabling the utilization of only eight (8) electromagnets as shown below in connection with stabilization in the horizontal plane and about three axes of rotation.

It was previously indicated that it should be understood that a preferred embodiment of present invention may be utilized for increasing ride comfort in an elevator car or cab. The preferred embodiment of the present invention was in part described first for a cab and will now be described for a car. Again, it will be apparent that the same approach is used for the car and cab, differing in detail only to the extent necessary to account for the fact that the actuators for a car act against a rail on a hoistway wall while the actuators for a cab act on a frame as shown in FIG. 14.

Figure 15:
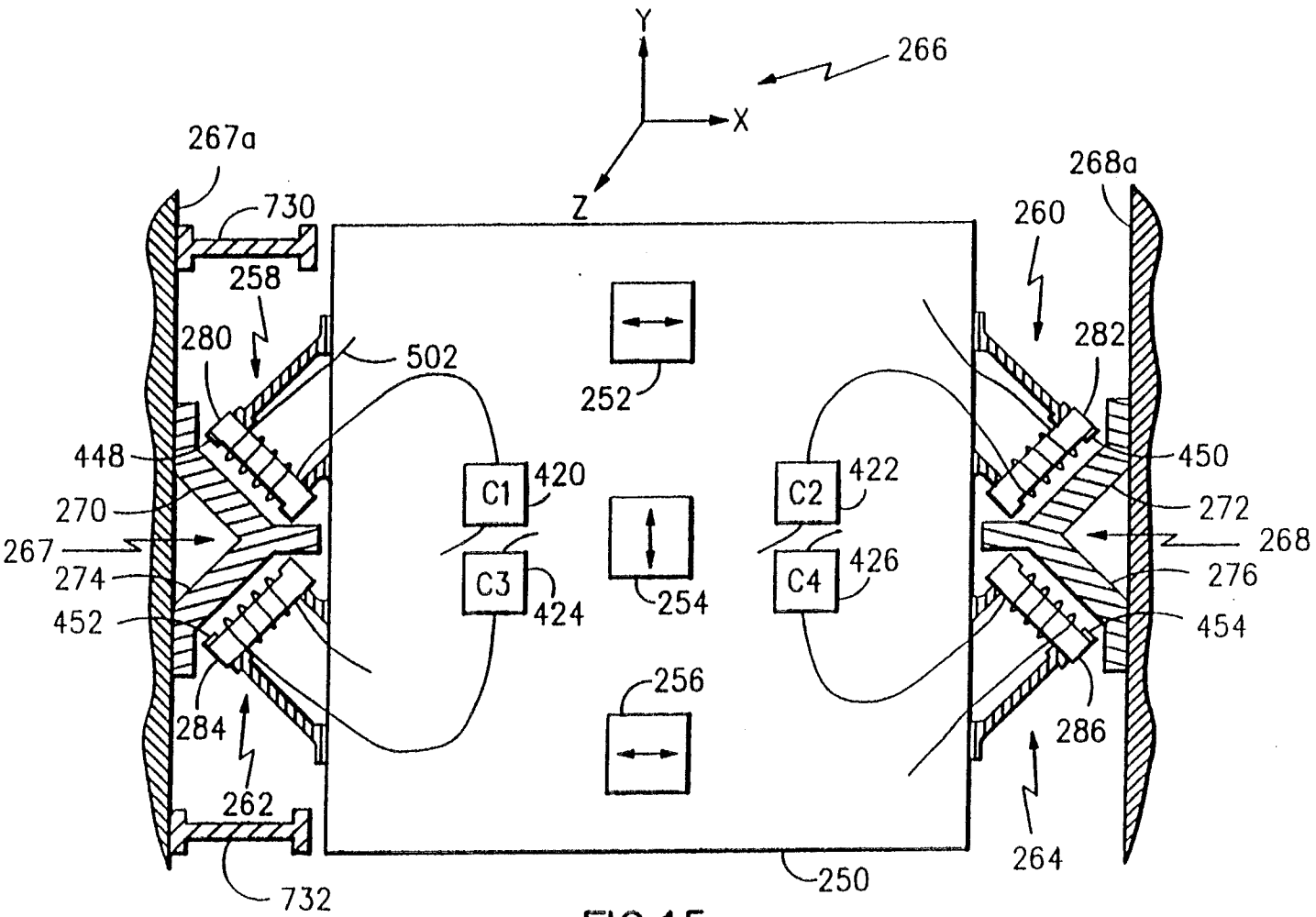
FIG. 15 is an illustration of an elevator car platform in plan view having an active control using "V" or triangular shaped rails, according to the present invention.

Referring now to FIG. 15, the bottom of a suspended or supported car 250 is presented in a plan view which shows the car at rest. Again, in a manner similar to the above presentation for a cab, for descriptive purposes and not by way of limitation, if one assumes a rectangular or, for even greater simplicity, a square layout for the passenger platform or car floor, one can visualize a pair of reaction planes perpendicular to the car 250 floor which intersect one another along a vertical car centerline which perpendicularly intersects the center of the square. The reaction planes may or may not intersect the floor along the floor's diagonals.

As mentioned, one way to view the preferred embodiment of the invention is to think of the control system as causing the elevator car's centerline to remain coincident with an imaginary reference line up the center of the hoistway without the suspended or supported car rotating about the coincident car and hoistway centerlines.

It does this by the use of car-mounted accelerometers 252, 254, 256 which together are used to sense accelerations manifesting small translational deviations of the car's centerline from the hoistway's centerline and by further sensing accelerations manifesting small rotations of the car about the hoistway centerline and by the selective use of actuators 258, 260, 262, 264 exerting forces perpendicular to the reaction planes to maintain the centerlines' desired coincidence with no rotation. A three dimensional coordinate system illustration 266 in FIG. 15 has its x-y plane in the paper and should be thought of as having its origin in the center of the square 250 and having its z-axis pointing up perpendicular to the paper toward the reader. It will be observed from the locations of the accelerometers that translational accelerations along the y-axis can be sensed by accelerometer 254 while those along the x-axis can be sensed by either accelerometer 252 or 256. A miscomparison of the outputs of the two x-sensitive accelerometers will indicate a rotation about the z-axis. A clockwise or counterclockwise rotation will be indicated depending upon which x-accelerometer 252 or 256 provides the larger magnitude sensed signal. I.e., the magnitude and sign of the miscomparison is indicative of the magnitude and direction of the angle of rotation.

V-shaped rails 267, 268, similar to the rail pictured in FIGS. 5 and 7, or similar, such as that of C. R. Otis, affixed to opposite hoistway walls 267*a*, 268*a* provide ferromagnetic reaction plates 268, 270, 272, 274. Four electromagnet cores 280, 282, 284, 286 with associated coils may be attached to the sides, near the bottom, of a suspended or supported platform so that each faces one of the reaction plates. Attractive forces generated by the control system by means of the four electromagnet core-coils are exerted in such a way as to separate or bring closer the core-coils from their associated reaction plates. The positioning of the core-coils with respect to the reaction planes can of course vary, as with the cab example, except in this case most especially according to the selected rail shape.

Figure 16:
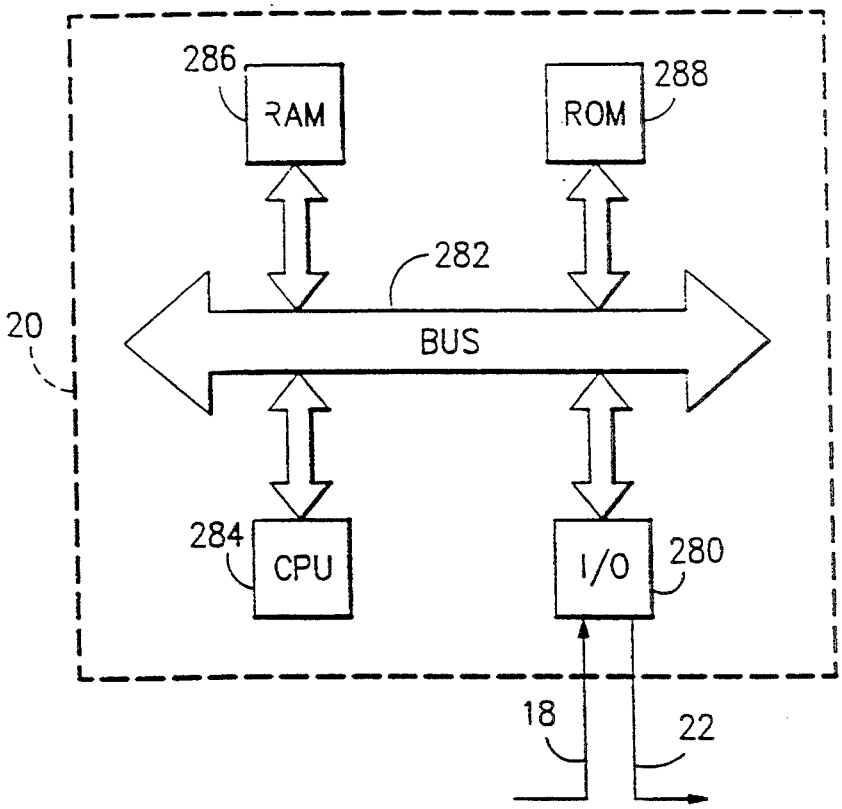
FIG. 16 is an illustration of a signal processor which may be used as the means shown in FIG. 1 for determining the magnitude of the response required to counteract disturbances, according to the present invention.

Turning now to FIG. 16, the means 20 of FIG. 1 is illustrated in a digital signal processor embodiment which may comprise an Input/Output (I/O) device 280 which may include an Analog-to-Digital (A/D) converter (not shown) responsive to an analog signal provided by sensor 16, which may be accelerometers 204, 206, 208 as shown in FIG. 14 or accelerometers 252, 254, 256 shown in FIG. 15, or any sensed parameter indicative of the effect(s) of the disturbance(s) 14. The I/O device 280 may further comprise a Digital-to-Analog (D/A) converter (not shown) for providing force command signals on line 22 to an analog actuator 24 which may instead comprise the actuators 210, 212, 214, 216 of Figure 14, the actuators 258, 260, 262, 264 of FIG. 15, or any other suitable actuators. Also within the control 20 of FIG. 16 is a control, data and address bus 282 interconnecting a Central Processing Unit (CPU) 284, a Random Access Memory (RAM) 286 and a Read Only Memory (ROM) 288. The CPU executes a step-by-step program resident in the ROM, stores input signals having magnitudes indicative of the value of the sensed parameter as manifested on the line 18, signals having magnitudes representing the results of intermediate calculations and output signals having magnitudes indicative of the value of the parameter to be controlled as manifested in the output signal on line 22.

Figure 48:
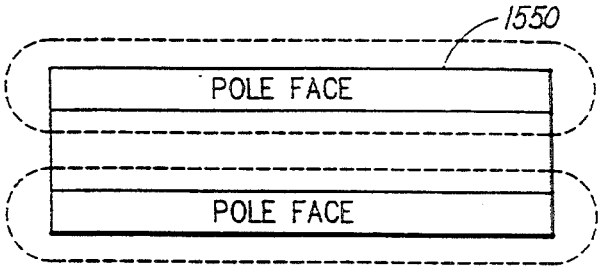
FIG. 48 is an illustration of a relatively long electromagnet core for orientation in a vertical manner, according to the present invention.

The cores 280, 282, 284, 286 of FIG. 15 may be shaped as shown in FIG. 48 and may have dimensions as described in connection with FIG. 50 and may be oriented as shown, with the "C" being horizontal and the long part of the core oriented vertically. Or, the core may be shaped rather stoutly as shown in FIG. 26 herein and be oriented as shown in FIG. 6 of Japanese Kokai 60-36279.

Figure 17:
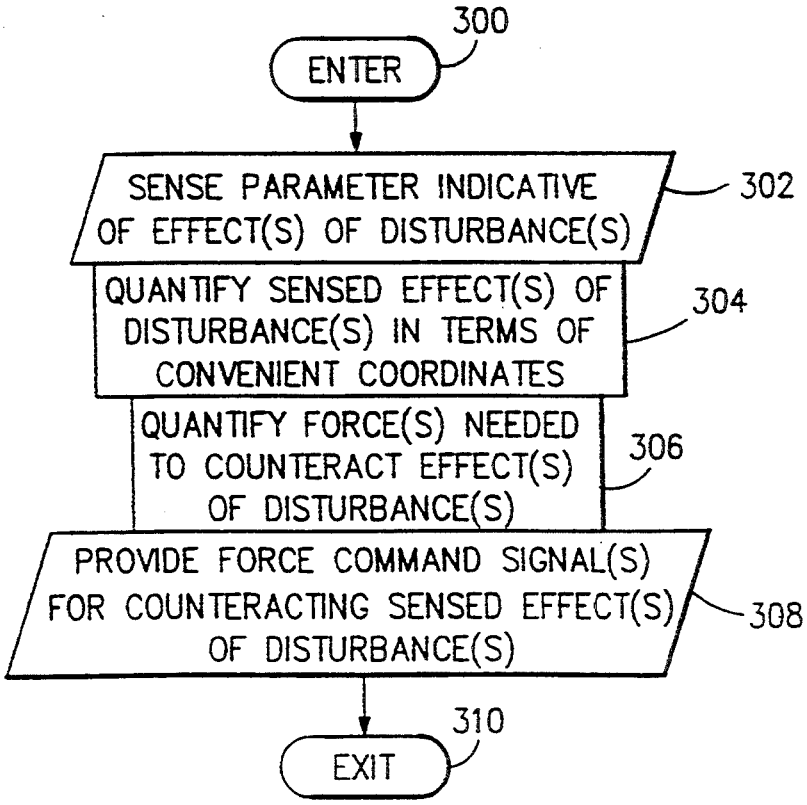
FIG. 17 is an illustration of a series of steps which may be carried out by the processor of FIG. 16 or its equivalent in determining the magnitude of the response required to counteract disturbances, according to the present invention.

Returning to the arrangement of the cab and car platforms of FIGS. 14 and 15 and at the same time referring to FIG. 17, a simplified step-by-step program will be explained for execution by the CPU of FIG. 16 in effecting the closed loop control function previously explained in connection with the means 20 of FIG. 1 and the embodiment thereof shown in FIG. 16. After entering at a step 300, an input step 302 is executed in which the magnitude(s) of the signal(s) on the line 18 is(are) acquired by the I/O unit 280. For the purposes of FIGS. 14 and 15, these shall be referred to as signals $A_{xl}$, $A_{x2}$ and $A_y$ provided, respectively, by accelerometers 204, 208, 206 of FIG. 14 or accelerometers 252, 256, 254 of FIG. 15 and stored in the RAM 286 of FIG. 16. One or the other of the two x-axis accelerometers 204, 208 (or 252, 256) can be used in a step 304 to compute the magnitude of a positive or negative $A_x$ signal, or both can be used as a check against one another, used to provide an average, or used in some such similar redundancy technique. (Of course, it should be realized that the steps 302, 304 can be combined into a single sensing step if a rotation sensor is provided along with two translational [x and y] sensors). From a comparison of the two signals provided by accelerometers 204, 208 (or, 252, 256) a computation of $A_\Theta$may be made in step 304. The magnitude of the signal $A_\Theta$will depend on the degree to which the magnitude of the signals from accelerometers 204, 208 (or, 252, 256) differ. The sign of their summation determines the rotational direction. The values of $A_x$, $A_y$ and $A_\Theta$are stored temporarily in RAM 286.

A step 306 is next executed in which a computation is made of the forces needed to counteract the effect(s) of the disturbance(s) as manifested in one or more sensed parameter(s) (accelerations preferred). Such may be made based on the known mass of the suspended or supported cab or car and the formula F=ma where "F" represents the required counterforce, "m" the mass of the suspended or supported cab or car and "a" the value of the sensed acceleration. Thus, $F_x$, $F_y$ and $F_\Theta$are computed from the signals $A_x$, $A_y$ and $A_\Theta$that were stored in RAM 186 in step 304. These computed values are provided in the form of force command signals on line 22 as indicated in a step 308. It should be understood that the orientation of the actuators as shown in FIGS. 14 and 15 are such that a command signal calling for a positive x-direction counterforce will have to be exerted by electromagnets 210 and 214 (or, 258, 262) acting in concert, each providing half the required counterforce by each providing a force equal to the commanded x-direction force multiplied by cos(45° ). Similar divisions of counterforces are made for the y-direction and for rotations as well. A set of formulae that will cover all the possibilities follows (in the following equations, the subscripts 1, 2, 3, 4 correspond, respectively, to electromagnetic actuators 210, 212, 214, 216 of FIG. 14 [or, actuators 258, 260, 262, 264 of FIG. 15]):

$$F_{x+}:\ F_1 = (KCS)(F_{x+}) \quad F_{x-}:\ F_2 = (KCS)(F_{x-})$$
$$F_3 = (KCS)(F_{x+}) \qquad F_4 = (KCS)(F_{x-})$$

$$F_{y+}:\ F_1 = (KCS)(F_{y+}) \quad F_{y-}:\ F_3 = (KCS)(F_{y-})$$
$$F_2 = (KCS)(F_{y+}) \qquad F_4 = (KCS)(F_{y-})$$

$$F_{\theta+}:\ F_2 = (KCS)(F_{\theta+}) \quad F_{\theta-}:\ F_1 = (KCS)(F_{\theta-})$$
$$F_3 = (KCS)(F_{\theta+}) \qquad F_4 = (KCS)(F_{\theta-})$$

where

F=force, and

KCS=cos(45°)=sin(45°)=0.707,

After making the necessary computations and providing the required counterforce command signals the program may then be exited in a step 310. However, it is preferable to add additional steps in order to superimpose a system for insuring against imperfectly levelled accelerometers and also against a changing offset in the accelerometers. For purposes of embodiments of the present invention, accelerometers have two major errors: (i) offset drift and (ii) pickup of unwanted gravity components due to not being perfectly level; also present, but not as significant, are (iii) linearity errors. A nonlevel accelerometer will sense accelerations due to gravity in proportion to the sine of the angle it makes with true vertical. Correction for nonlinearity is not usually important in embodiments of this invention but may be corrected for, if desired. Assuming the nonlinearity retains its basic relationship with true linearity as adjusted for changes in offset, such nonlinearity may be corrected at each stage of sensed acceleration by consulting a lookup table which is used to supply a corrective factor. If offset were constant over time it could be corrected for straightforwardly with a constant correction factor. But, since offset can change over time due to temperature, aging, etc., corrections should be made in a dynamic manner. Offset and changing offset, as well as accelerations due to gravity, can be corrected by providing a relatively slower acting feedback control system for controlling the position of the car or cab with respect to the hoistway centerline. This may be done by recognizing that the average lateral acceleration must be zero (or the car or cab would travelling off into space). The slow acting loop offsets the average accelerometer output signal. Averaging may be accomplished, e.g., using an analog low-pass filter or a digital filter.

Figure 18:
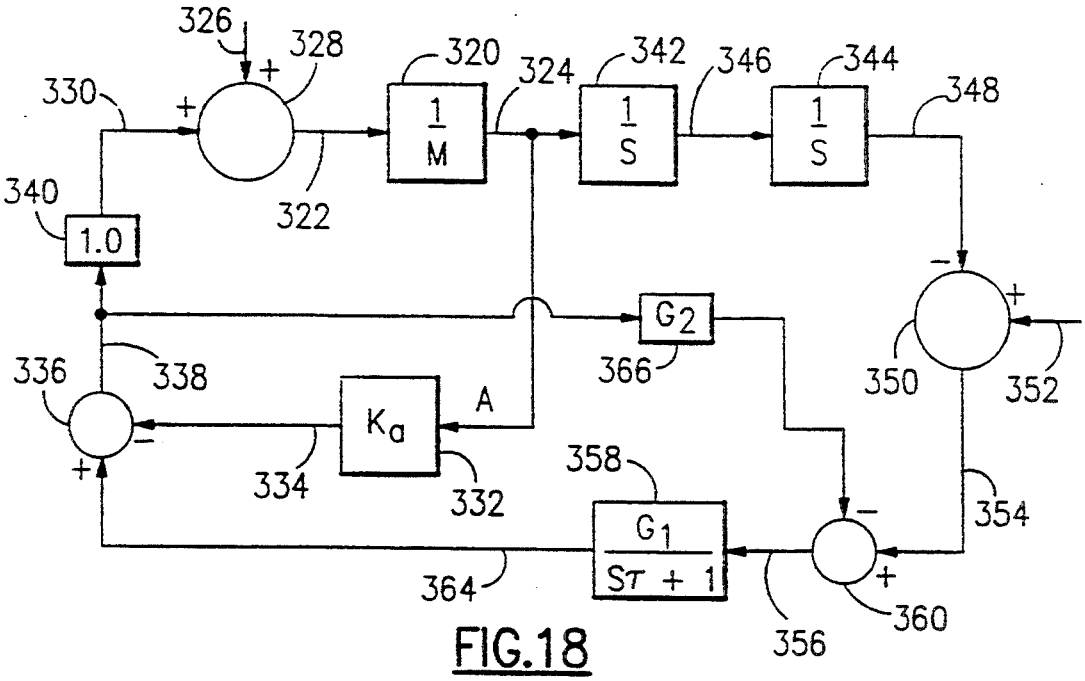
FIG. 18 shows a mathematical abstract of a preferred control scheme for carrying out the active control of FIG. 1.

Thus, if we think of a single axis of control such as the x-axis shown in FIGS. 14 or 15, the theory of operation of such a system for controlling the cab or car with both acceleration and position sensors is shown in FIG. 18. The system in elementary form comprises the car or cab mass as illustrated by a block 320. The car or cab mass is acted upon by a force on a line 322 which causes an acceleration as illustrated by a line 324. A disturbing force is shown schematically as a signal on a line 326 summed in a "summer" 328 (an abstract way of representing that the disturbing force is physically opposed by the counteracting force) with a counterforce signal on a line 330 provided in proportion ($K_a$) to the acceleration (A) shown on the line 324 as sensed by an accelerometer 332 which provides a sensed acceleration signal on a line 334 to a summer 336. The scale factor ($K_a$) of the accelerometer is (volt/$m^2$/s). (As previously indicated, the acceleration on line 324 is produced by the disturbing force on line 326 interacting with the mass of the suspended or supported car or cab according to the relation F/M as suggested in block 332, where F is the disturbing force and M is the mass of the car or cab. The summer 328 represents the summation of the disturbing force on line 326 and the counterforce on line 330 to provide a net force on a line 322 acting on the mass 320.) The summer 336 may provide a signal on a line 338 to a force generator 340 which may have a transfer characteristic of 1.0 Newton/volt. The summer 336 serves to collect an inner acceleration loop signal on line 334 with the outer acceleration and position loop signals to be described below prior to introduction on the line 338 into the force generator 340. The inner acceleration loop comprising elements 320, 332, 340 and the associated summers forms the primary control loop used for "mass augmentation" as defined herein.

The description of FIG. 18 so far covers the theory of the control system previously described in connection with FIGS. 1–17. Secondary control loops may also be added as illustrated in the abstract in FIG. 18.

Shown are two secondary control loops which may be used for nulling offsets in the accelerometer 332 caused, e.g., by misalignment with gravity and due to manufacturing imperfections. The first of these secondary loops corrects on the basis of position offsets. A position transducer that gives car position is represented abstractly by an integrator block 342 and an integrator block 344. The integrator 342 provides a velocity signal on a line 346 to the integrator 344 which in turn provides a position signal on a line 348. The cab position signal on line 348 is compared in a summer 350 with a reference signal on a line 352. The signal on the line 352 would ordinarily be a fixed DC level scaled to represent, e.g., the x-position (in the cab coordinate system 218 of FIG. 14 or in the car coordinate system 266 of FIG. 15) of a selected referent such as the hoistway centerline (which will be substantially coincident with true vertical, i.e., a line along which the earth's gravity will act). this entire process is carried out in practice by use of a position sensor that gives the relative position between the cab and car frame. The summer 350 provides a signal on a line 354 which represents the relative position of the cab with respect to the frame and may be characterized as the relative position signal or the position error signal. It is provided on a line 356 to a low-pass filter 358 after being summed in a summer 360 with a signal on a line 362. The low-pass filter 358 provides a filtered signal on a line 364 which causes the force on the line 330 to be applied on the line 322 to the car or cab 320 until the position error signal is driven to zero or close to zero.

A second secondary control loop may be introduced if a position signal is not conveniently available or to enhance the stability of the position correction control loop. The position error signal on line 354 may thus be modified in the summer 360 by being summed with the signal on line 362 which is provided by a gain block 366 which is in turn responsive to the signal on line 338 which is representative of the acceleration sensed in the primary loop.

An extraneous signal on line 338 will appear directly on line 322 if $G_1=0$ and $G_2=0$. Assuming no indicated position error on line 354 and nonzero gains $G_1$ and $G_2$, a disturbance manifested by an acceleration signal on line 334 will appear on line 322 reduced by a dynamic factor $$\frac{s\tau + 1}{s\tau + (1 + G_1 \cdot G_2)}$$

This factor approaches unity at higher frequencies, indicating no effectiveness. At lower frequencies, however, this factor approaches $[1/(1+G_1{*}G_2)]$. Typically, $G_1{*}G_2$ could be chosen equal to nine (9) to reduce accelerometer offsets by a factor of ten (10).

The position feedback loop offers the advantage of very low error. Without the accelerometer feedback loop 366, 360, 358, 336 and/or practical control elements being present this loop may not be as stable. Assuming gain $G_2=0$, the only way for the position loop to be stable is for the car or cab mass to be acted upon by damping, friction and an inherent spring rate due to pendulousity, acting singly or in concert. One or more of these elements will be present in a practical system. Use of an accelerometer loop by making $G_2$ nonzero can enhance the operation of the position loop.

Figure 19:
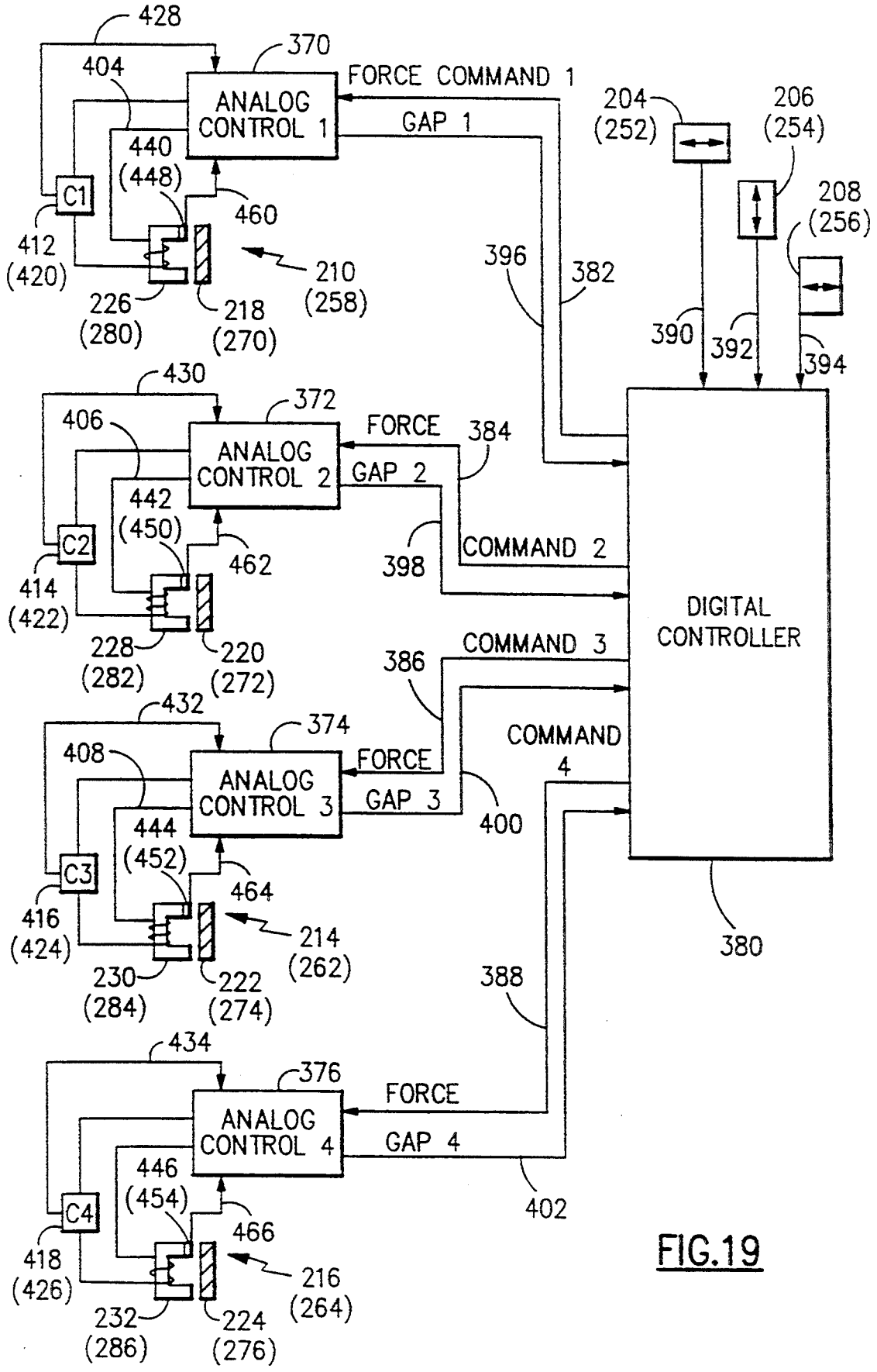
FIG. 19 shows preferred means for carrying out the preferred control scheme of FIG. 18.

The control represented in the abstracted form in FIG. 18 may be carried out in numerous different ways, including a wholly digital approach similar to that of FIG. 16, but a preferred approach is shown in FIG. 19.

There, a fast-acting analog loop for quickly counteracting disturbing forces is combined with a slower acting but more accurate digital loop for compensating for gravity components and drifts in the accelerometers. A plurality of such fast-acting analog loops may be embodied in analog controls 370, 372, 374, 376 as shown, one for each of the respective actuators 210 or 258, 212 or 260, 214 or 262, 216 or 264, of FIGS. 14 or 15, respectively. With proper interfacing (not shown), a single digital controller 380 can handle the signals to be described to and from all four analog controls. Each analog control responds to a force command signal on lines 382, 384, 386, 388 from the digital controller 380. The force command signals will have different magnitudes depending on the translational and rotational forces to be counteracted. The digital controller 380 is in turn responsive to acceleration signals on lines 390, 392, 394 from the accelerometers 204 or 252, 206 or 254, 208 or 256, respectively (the accelerometers being from either FIG. 14 or 15), and to position signals on lines 396, 398, 400, 402 indicative of the size of the airgaps between the coil-cores 226 or 280, 228 or 282, 230 or 284, 232 or 286 and their respective plates 218 or 270, 220 or 272, 222 or 274, 224 or 276.

In response to the force command signals on lines 382, 384, 386, 388, the analog controls 370, 372, 374, 376 provide actuation signals on lines 404, 406, 408, 410 to the coils of the coil-cores 226 or 280, 228 or 282, 230 or 284, 232 or 286 for causing more or less attractive forces between the respective core-coils 226 or 289, 228 or 282, 230 or 284, 232 or 286 and their associated reaction plates. The return current through the coils is monitored by current monitoring devices 412 or 420, 414 or 422, 416 or 424, 418 or 426 which provide current signals on lines 428, 430, 432, 434 to the respective analog controls 370, 372, 374, 376. The current sensors may be, e.g., Bell IHA-150 with multiple looping of the "through" lead.

A plurality of sensors 440 or 448, 442 or 450, 444 or 452, 446 or 452, which may be Hall cells (e.g., of the type Bell GH-600), are respectively associated with each core 226 or 280, 228 or 282, 230 or 284, 232 or 286, for the purpose of providing an indication of the flux density or magnetic induction (volt-sec/$m^2$) in the gap, i.e., between the faces of the cores and the associated plates or, otherwise stated, the flux density in the airgaps therebetween. The sensors 440 or 448, 442 or 450, 444 or 452, 446 or 452 provide sensed signals on lines 460, 462, 464, 466, respectively, to the analog controls 370, 372, 374, 376.

Figure 20:
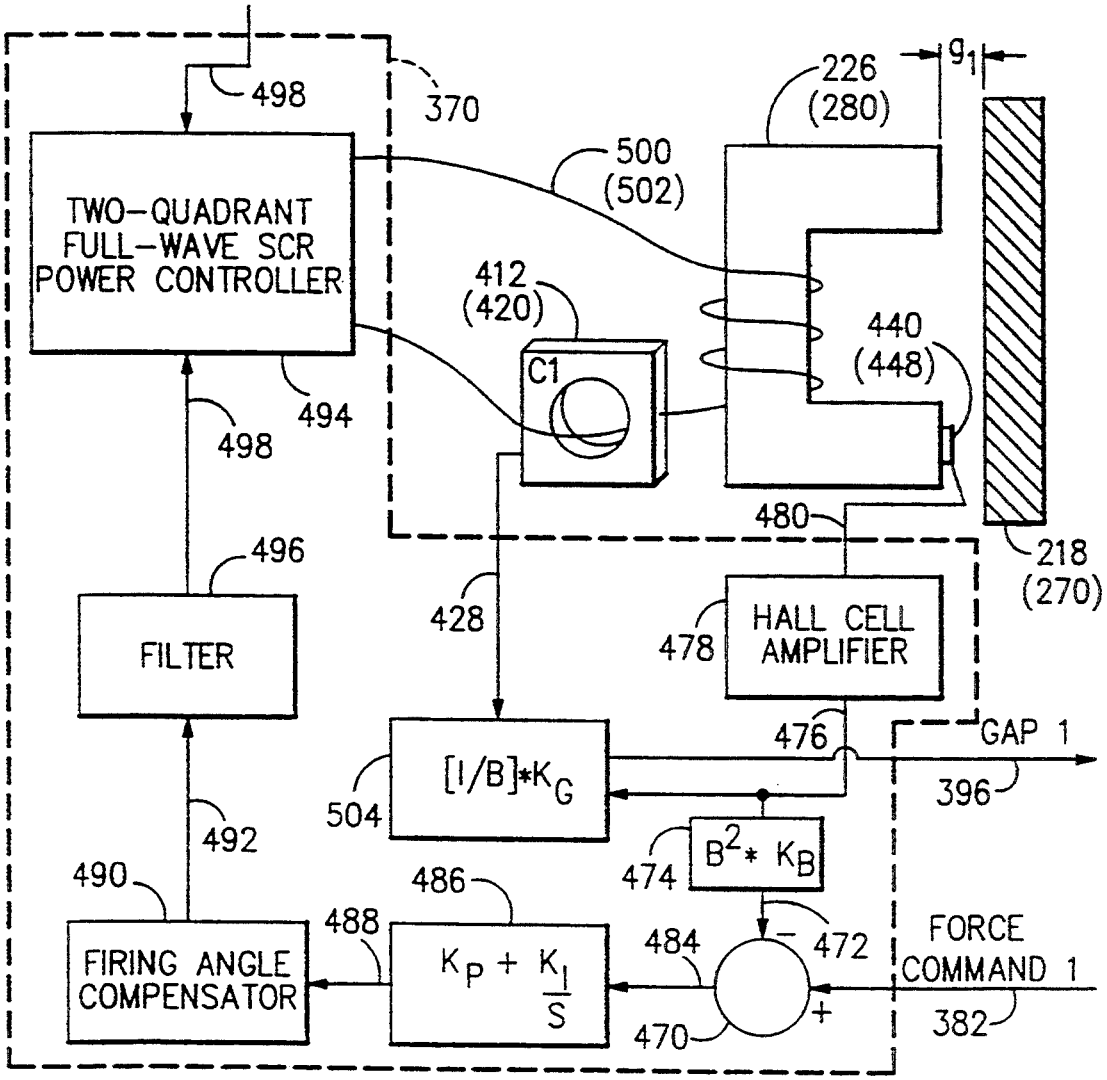
FIG. 20 shows an analog control of FIG. 19 in more detail.

Referring now to FIG. 20, the analog control 370 among the plurality of analog controls 370, 372, 374, 376 of FIG. 20, is shown in one embodiment in detail. The other analog controls 372, 374, 376 may be the same or similar. The force command signal on line 382 from the digital controller 380 of FIG. 20 is provided to a summer 470 where it is summed with a signal on a line 472 from a multiplier 474 configured as a flux density squaring circuit (to linearize control) having a gain selected dimensionally to be equivalent to meter-coulomb$^2$/kilogram and properly scaled to convert a signal on a line 476 indicative of flux density to one indicative of force. The flux density signal on line 476 is provided by a Hall cell amplifier 478 which is used to boost the level of the signal on line 480 from the Hall cell 440 or 448.

The summer 470 provides a force error signal on a line 484 to a proportional-integral (P-I) amplifier 486 which provides a P-I amplified signal on a line 488 to a firing angle compensator 490. Compensator 490 provides a firing angle signal on a line 492 which controls the firing angle of a plurality of SCRs in a controller 494 after being filtered by a filter 496 which in turn provides a filtered firing angle signal on a line 498 to the controller 494 which is more fully described as a single phase, two-quadrant, full-wave, SCR power converter. This type of converter is preferred over one-quadrant and half-wave converters. The least preferred combination would be a one-quadrant, half-wave. There would be a slight cost savings in using these non-preferred approaches but the dynamic performance would be significantly degraded. An inexpensive, one-quadrant system is possible using a DC rectifier and a transistor PWM chopper. The highest performance approach would be a full-wave, two-quadrant, three phase converter but this is not the preferred approach because of cost considerations. The two-quadrant full wave converter 494 of FIG. 21 may be made up, for example, of a pair of Powerex CD4A1240 dual SCRs and a commercial firing board such as a Phasetronics PTR1209. The power controller 252 is powered with 120 VAC on a line 498 as is the firing board and provides the proper level of current on line 500 or 502 in response to the filtered firing angle signal on line 498.

The signal on the line 428 from the current sensor 412 or 420 is provided to an analog multiplier/divider 504 (such as an Analog Devices AD534) which is also responsive to the flux density signal on line 476 for dividing the magnitude of the current signal on line 428 by the magnitude of the flux density signal on line 476 and multiplying the result by a proportionality factor in order to provide the signal on line 396 (back to the digital controller 380 of FIG. 20) indicative of the magnitude of a gap ($g_1$) between the face of the core of the core-coil 226 or 280 and the plate 218 or 270.

As mentioned previously, the digital controller 380 is responsive to the gap signals on the lines 396, 398, 400, 402, as well as the acceleration signals on lines 390, 392, 394, for carrying out, in conjunction with the analog control of FIG. 20, the control functions of FIG. 18. Instead of generating force signals on the lines 382, 384, 386, 388 in exactly the same manner as previously disclosed in connection with FIGS. 16 and 17, such signals, though generated in a similar manner, are modified by summation with corrective force signals calculated to correct for position imbalances detected by the position sensor 440 or 448 and similar sensors 442 or 450, 444 or 452, 446 or 452 associated respectively with the actuators 212 or 260, 214 or 262, 216 or 264 as shown in FIGS. 14 or 15. (Note: These are the Hall sensors used to find flux density. The signals from the position sensors such as sensor 440 or 448 and from current sensor C1, when processed by the divider circuit 504 give the GAP1 signal on line 396. Similar processing in the other channels yields the GAP2, GAP3 and GAP4 signals on lines 398, 400, 402.) Such corrective force signals may be generated, for example, by first resolving the sensed position signals into components along the axes of the cartesian coordinate system 218 or 266 of FIG. 14 or 15 as in the equations which follow, $$P_{x+}=(P_1+P_3)/(2KCS),\ P_{x-}=(P_2+P_4)/(2KCS),$$

$$P_{y+}=(P_1+P_2)/(2KCS),\ P_{y-}=(P_3+P_4)/(2KCS),$$

$$P_{\Theta+}=(P_2+P_3)/2,\ P_{\Theta-}=(P_1+P_4)/2,$$

and then, based on the above, computing or selecting $P_x$, $P_y$, and $P_\Theta$(which together specify the absolute position of the car or cab), from $P_{x-}$and $P_{x+}$, $P_{y-}$and $P_{y+}$, and $P_{\Theta+}$ and $P_{\Theta-}$. $P_x$, for example, may be computed as follows:

$$P_x=(P_{x+}-P_{x-})/2.$$

Or, one can select $P_{x+}$ or $P_{x+}$, depending on which quantity is smaller. (Note: For large gaps, i.e., for large $P_+$ or $P_{x-}$, the value is likely to be inaccurate and may be discarded). The resultant components are used to determine position-control force components $F_{px}$, $F_{py}$, $F_{p\Theta}$ as illustrated in FIG. 18 on a single-axis basis ("p" stands for position feedback). $P_x$, for example on line 348, is compared to a reference on line 352 to generate an x-position error signal on line 354. This in turn is passed through a low-pass such as filter 358. This provides an $F_{px}$ signal. For purposes of resolving the required x-counterforce, if a positive force is required, $F_{p1}=F_{p3}=(0.5)(F_{px})/(\cos 45°)$. For a negative force, $F_{p2}=F_{p4}=(0.5)(F_{px})/(\cos 45°)$. This same procedure may be followed for $F_{py}$ and $F_{pe}$ using, of course, the appropriate equations. Thus, the force components $F_{px}$, $F_{py}$ and $F_{p\Theta}$ may be resolved into corrective signals $F_{p1}$, $F_{p2}$, $F_{p4}$, according to the following complete set of equations, $$F_{px+}:\ F_1=(KCS)(F_{px+})\quad F_{px-}:\ F_2=(KCS)(F_{px-})$$
$$F_3=(KCS)(F_{px+})\qquad F_4=(KCS)(F_{px-})$$

$$F_{py+}:\ F_1=(KCS)(F_{py+})\quad F_{py-}:\ F_3=(KCS)(F_{py-})$$
$$F_2=(KCS)(F_{py+})\qquad F_4=(KCS)(F_{py-})$$

$$F_{p\theta+}:\ F_2=(KCS)(F_{p\theta+})\quad F_{p\theta-}:\ F_1=(KCS)(F_{p\theta-})$$
$$F_3=(KCS)(F_{p\theta+})\qquad F_4=(KCS)(F_{p\theta-})$$

where

F= force, and

KCS=cos(45° )=sin(45° )=0.707, which are then summed with the acceleration feedback signals $F_1$, $F_2$, $F_3$, $F_4$ (such as the signal on line 364 or line 382) generated in the manner previously described in connection with FIGS. 1–20.

It should be realized that a valid position reading will only be available from the flux sensors of the type described unless its associated force actuator is being driven. This means that any processing algorithm must be dependent upon whether or not there are magnet coil actuation currents present.

It should be realized that the gap signals on lines 396, 398, 400, 402 could be provided by a simple position sensor only.

An additional teaching of our invention is that the electromagnets may be used to control the position of the car or cab at stops, e.g., to bring the suspended or supported car or cab to rest with respect to the frame while on- and off-loading passengers. Of course, the signal processor of Fig. 16, the digital controller 380 of FIG. 19 or an additional signal processor may handle additional control functions such as the starting and stopping of cars and the dispatching of cars. In the case of stopping at a floor, it may receive a sensed signal on line 24 or an algorithmically determined but similar signal indicating the car is vertically at rest and will then provide a signal on line 18 to control the position of the suspended or supported car or cab. For, example, if the cab platform 200 of FIG. 14 is oriented in the hoistway such that the left hand vertical edge of the cab represents the cab's sill in alignment with a hoistway door sill 510, then the signal processor 20 of FIG. 16 may be programmed to provide force command signals to actuators 210, 214 in order to provide the attractive forces needed to force the suspended cab up against, e.g., stops 512, **512*a* mounted in the car frame 202 so as to push the cab sill into position at rest with respect to, and in close alignment with the hoistway entrance sill after the frame 202 comes to rest. Or, the stops may be part of the actuators themselves, for example, mounted on the top faces of the legs 704, 706 of the core shown in FIG. 26 such that in applying some selected current level for the coils, an attractive force is generated that is sufficiently strong to bring the stops up against the reaction plates. For a double-doored platform, as a further example, if the platform 200 of FIG. 14 is oriented in the hoistway such that the left hand vertical edge of the cab represents the cab's sill in alignment with a hoistway door sill 510, and the right hand vertical edge is at the same time in alignment with a sill 514 then the signal processor 20 of FIG. 16 may be programmed to provide force command signals to actuators 212, 216 in order to provide the attractive forces needed to force the suspended cab up against, e.g., stops 513, 513*a* mounted in the car frame 202 so as to push the cab sill into position at rest with respect to, and in close alignment with the hoistway entrance sill 514 after the frame 202** comes to rest.

Figure 23:
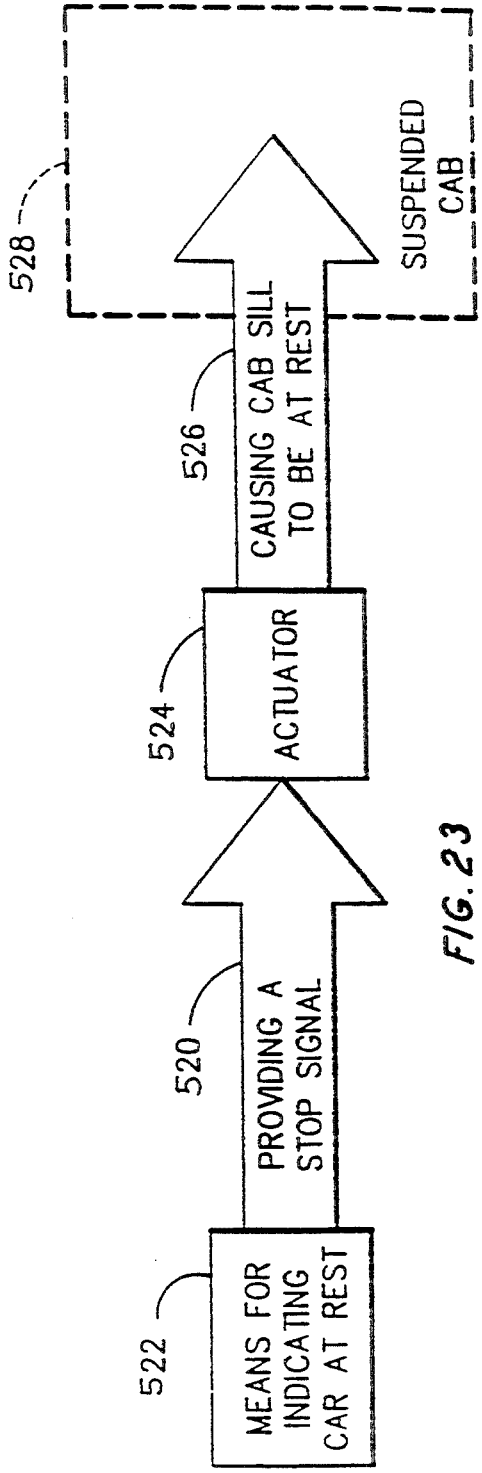
FIG. 23 illustrates steps which may be carried out in using actuators to bring a suspended or supported platform to rest at a sill, according to the present invention.

The method used to accomplish the same is shown in FIG. 23 where a stop signal is provided in a step 520 from means 522 (which may be incorporated in the processor 380 in an additional role of controlling a car or group of cars) for indicating the car frame has come to rest vertically, providing a stop or stop command signal and, in response thereto, an actuator 524 (which may be actuators 210 and 214 or 212 and 216 acting in concert) provides an actuating signal as shown in a step 526 for causing a suspended cab 528 (which may be cab 200) to come to rest with respect to the car frame (which may be frame 202) such that the cab sill is adjacent to the hall sill and motionless with respect thereto.

A similar set of electromagnet stops or mechanical stops 530, 532 can be provided at each landing for the car of FIG. 15 to be pushed against and a similar procedure as that of FIG. 23 can be followed.

Figure 22:
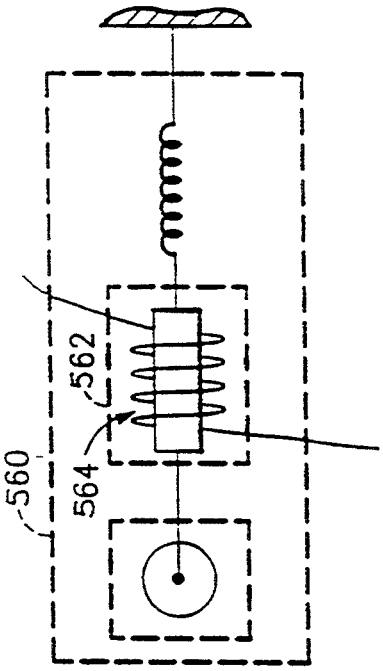
FIG. 22 shows a solenoid actuated wheel for use in an active system such as that of FIG. 21.
Figure 21:
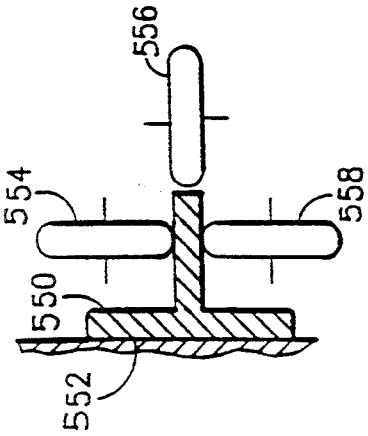
FIG. 21 is an illustration of a three wheel active guide, according to the present invention.

It should be understood that although a preferred embodiment of the invention utilizes electromagnetic, noncontact type actuators and, in particular, in connection with a suspended or supported car uses electromagnetic actuators such as are shown in FIG. 15 in conjunction with hoistway rails, it is also possible to employ contact-type, active actuators. For example, FIG. 21 shows a standard rail 550 attached to a hoistway wall 552 having three contact-type actuators having wheels 554, 556, 558 in contact therewith for guiding an elevator car. FIG. 22 shows one of the actuators 560 in detail having wheel 554 associated therewith actuated with a solenoid 562 having a coil 564 similar to a coil which would be used in an electromagnet actuator of the previously disclosed, contact-less type. The other wheels 556, 558, would have similar solenoids associated therewith.

FIG. 24 shows a reduced block diagram of the same concept presented in FIG. 18 above. The reduced model is valid at all but the lowest frequencies.

The FIG. 24 diagram may be expressed in units scaled to as follows:

Acceleration of cab $-[FD/G][1/(M+Ka)]$ where

FD is the disturbing force,

M is the mass of the suspended cab,

Ka is the counter-mass "added" by the actuator, and

FD/G is the mass equivalent of the disturbing force using the acceleration due to gravity (G) at the earth's surface.

If, in the foregoing equation, we let Ka=0, i.e., we assume the absence of active control, and let M=1000 kg and FD/G=25 kg, then we obtain an acceleration due to the disturbing force (FD) of 25/1000=25 mG. If we now wish to introduce active control, we can assume Ka=9000 kg and we now obtain a tenfold reduction in acceleration due to the disturbance, i.e., 25/(1000+9000)=2.5 mG. We can thus conclude that if we proceed along these lines we will at least have an order of magnitude improvement in ride comfort.

Now, assuming a Ka of 9000 kg is desired, we can assume an acceleration scale factor (ASF) of 100 Volt/G and a force generator scale factor (FGSF) of Ka/ASF (the product of ASF and FSGF yields $K_a$) which in this case yields 9000 kg/100 Volt/G=90 kg(force)/Volt or, equivalently, 882 Newton/Volt.

An electromagnet actuator such as described previously may be constructed in a U-shape as shown in FIGS. 25 and 26. In FIG. 25, double coils 700, 702 are shown which fit over legs 704, 706 respectively, as shown in FIG. 26. The coils 700, 702 constitute a continuous winding and are shown in isometric section in FIG. 25. Coil 700 and coil 702 may each, for example be wound with 936 turns of #11 AWG magnet wire at a 0.500 packing factor. The U-shaped core may, for example, be of interleaved construction, 29 GA M6 laminations made of 3.81 cm strip stock, vacuum impregnated. The dimensions shown in FIG. 26 may be, for example, A=10.16 cm, B =3.81 cm, C=7.62 cm and D=7.62 cm. In that case, the resistance would be 6.7 ohms and the inductance 213 mH. Such weighs 22.2 kg and is capable of exerting 578 Newtons.

If we use such an electromagnet actuator in a control system such as described previously we can expect an average delay in responding to a command of, say, 4.2 msec. The time delay to develop a full force, say, of 578 Newton at a maximum gap of 20 mm can be estimated at 15 msec as follows (based on the relation v=Ldi/dt):

$$t=L\ i/v=(0.3)\ (8.6)/(170)=15\ \text{msec.}$$

The time to develop full force (578 Newton) at minimum gap (5 mm) would be:

$$t=L\ i/v=(1.2)\ (2.15)/(170)=15\ \text{msec.}$$

as well.

Figure 27:
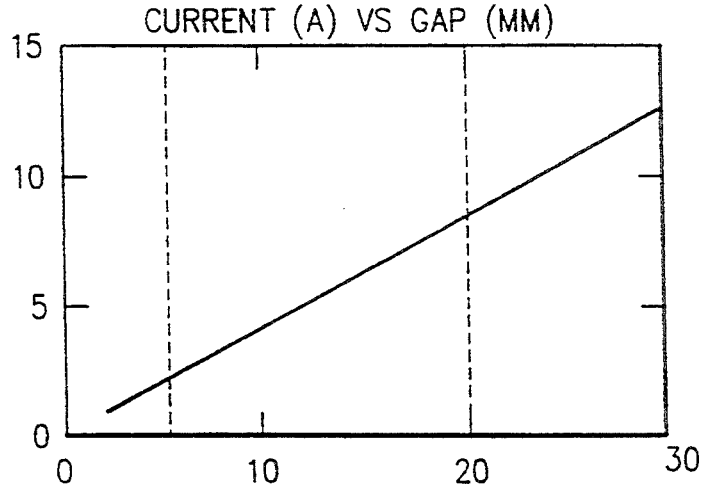
FIG. 27 is a plot of coil current vs. airgap, according to the present invention.
Figure 28:
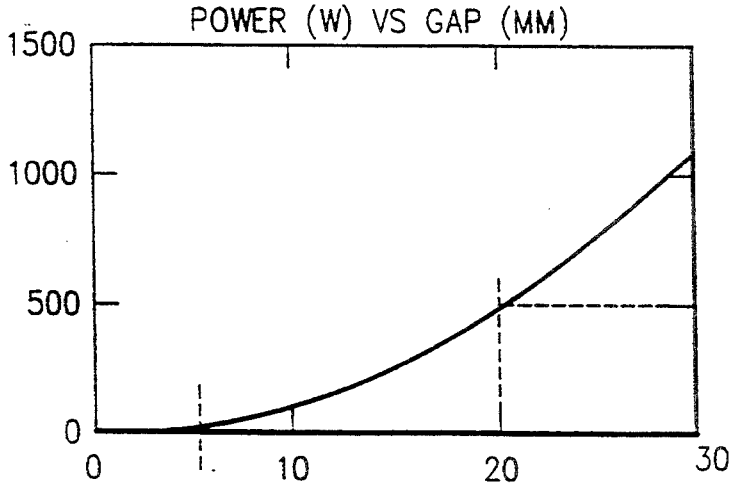
FIG. 28 is a plot of power vs. airgap, according to the present invention.
Figure 29:
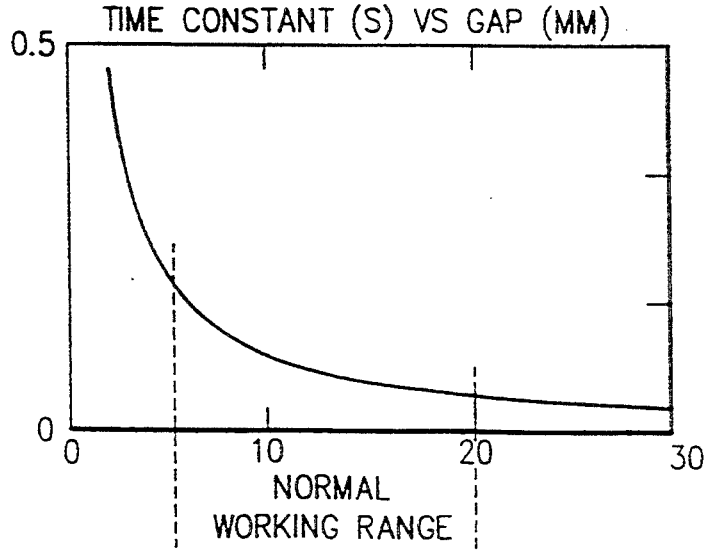
FIG. 29 is a plot of time constant vs. airgap, according to the present invention.

The time to develop half force would of course be half the time. An accuracy in the gap signal of 10% of full scale can be tolerated. We can present the relation between the gap and several other factors in graphical form as shown in FIGS. 27, 28 and 29. The maximum power is 500 Watts at a maximum allowed 20 mm gap. The average power can be expected to be approximately 125 Watts.

As for short term thermal considerations, the mass of the copper in such an electromagnet is 14.86 kg, having a specific heat of 0.092 cal/g-° C. (=385J/kg° C). The change in temperature for a sixty second application of energy at a rate of 500 Watts will thus be:

$$\begin{aligned} T &= \text{Watt-sec}/(385)(14.86) \\ &= (500)(60)/(385)(14.86) \\ T &= 5.24^\circ\ \text{C.} \end{aligned}$$

Thus, there is little temperature rise even for maximum power input for one minute.

Figure 30:
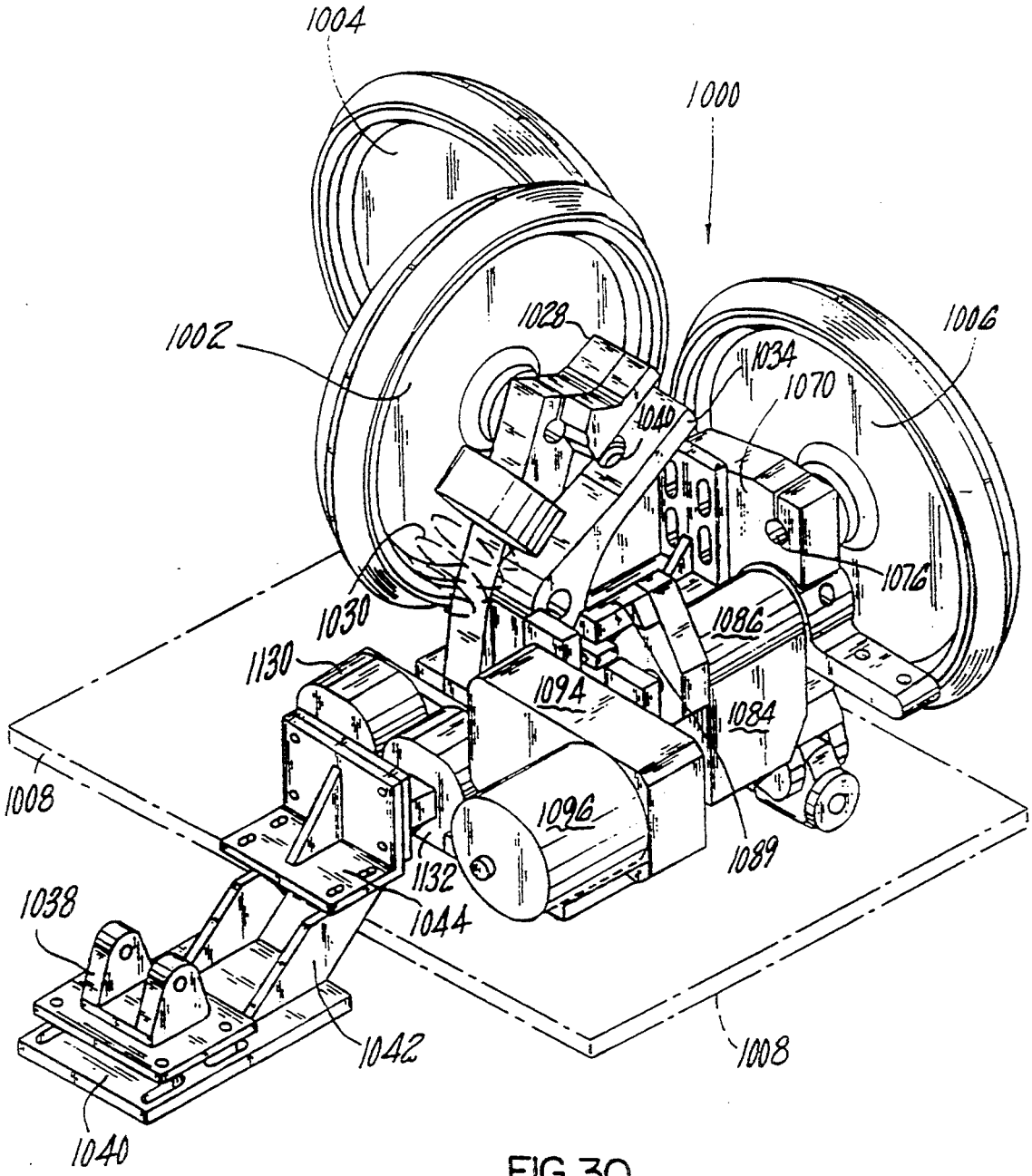
FIG. 30 is a perspective view of a guide roller cluster, according to the present invention.
Figure 31:
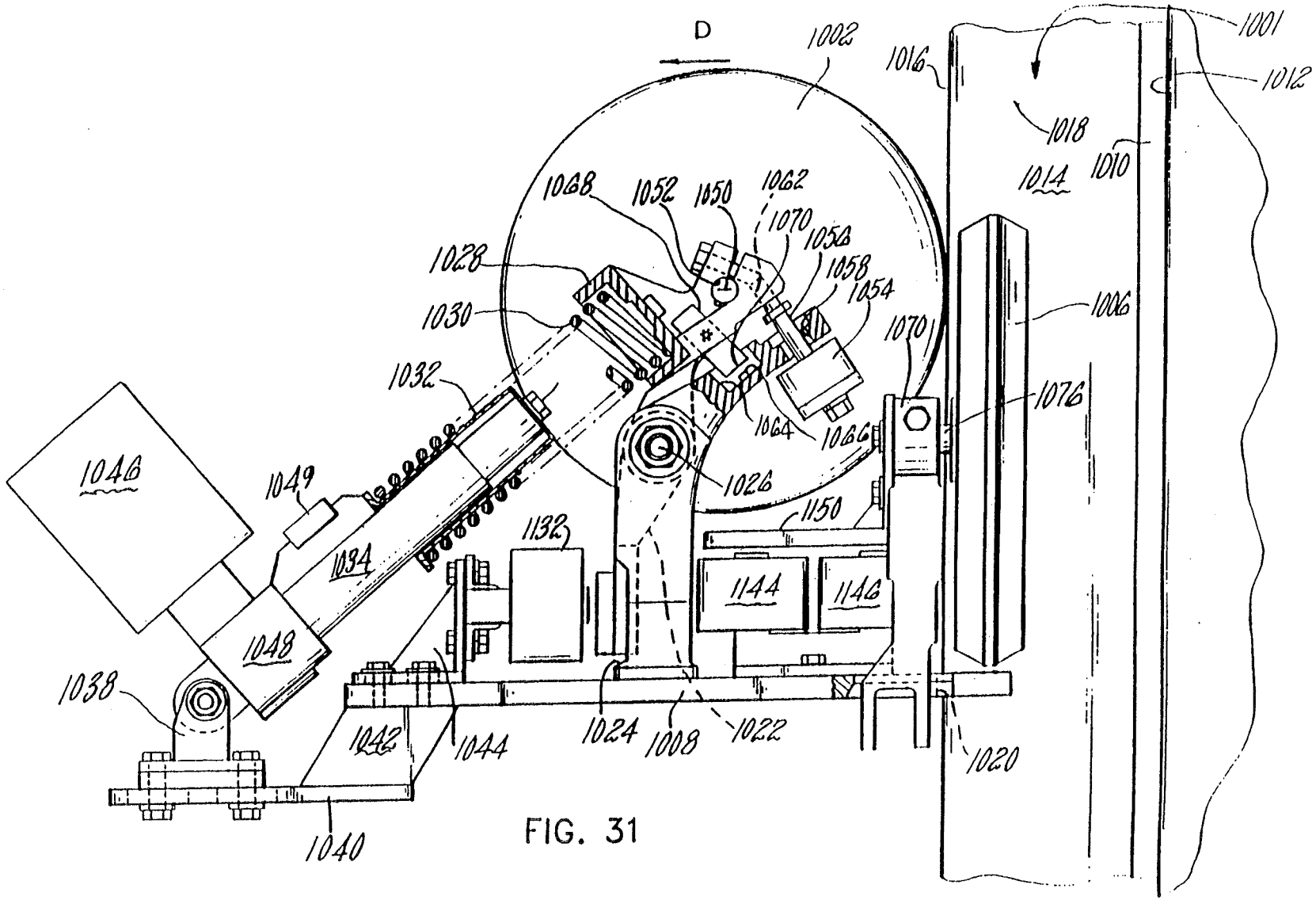
FIG. 31 is a side elevational view of the guide roller cluster of FIG. 30 showing details of the secondary suspension's side-to-side roller adjustment mechanism.

FIGS. 30 and 31 are still other illustrations of an embodiment of means for carrying out the present invention, in the form of an "active" roller guide, showing details of a roller cluster 1000. Although one of the rollers (side-to-side) is elevated with respect to the other two, it will be appreciated that the roller cluster 1000 is a relatively conventional arrangement of rollers on a rail 1001. However, we are only aware of such clusters being used passively and we know of no such prior art roller cluster used with actuators.

The cluster 1000 includes a side-to-side guide roller 1002 and front-to-back guide rollers 1004 and 1006. The roller cluster 1000 is mounted on a base plate 1008 which is fixed to an elevator cab frame crosshead (not shown). The guide rail 1001 will be a conventional, generally T-shaped structure having basal flanges 1010 for securement to the hoistway walls 1012, and a blade 1014 which projects into the hoistway toward the rollers 1002, 1004 and 1006. The blade 1014 has a distal face 1016 which is engaged by the side-to-side roller 1002, and side faces 1018 which are engaged by the front-to-back rollers 1004 and 1006. The guide rail blade 1014 extends through a slot 1020 in the roller cluster base plate 308 so that the rollers 1002, 1004 and 1006 can engage the blade 1014.

As shown most clearly in FIG. 31, the side-to-side roller 1002 is journaled on a link 1022 which is pivotally mounted on a pedestal 1024 via a pivot pin 1026. The pedestal 1024 is secured to the base plate 1008. The link 1022 includes a cup 1028 which receives one end of a coil spring 1030. The other end of the spring 1030 is engaged by a spring guide 1032 which is connected to the end of a telescoping ball screw adjustment device 1034 by a bolt 1036. The adjuster 1034 can be extended or retracted to vary the force exerted on the link 1022, and thus on the roller 1002, by the spring 1030. The ball screw device 334 is mounted on a clevis 1038 bolted to a platform 1040 which in turn is secured to the base plate 1008 by brackets 1042 and 1044. The use of the platform 1040 and brackets 1042 and 1044 allows the assembly to be retrofitted on a conventional roller guide assembly directly on the existing base plate 1008. The ball screw device 1034 is powered by an electric motor 1046. A ball screw actuator suitable for use in connection with this invention can be obtained from Motion Systems Corporation, of Box 11, Shrewsbury, N.J. 07702. The actuator motor 1046 can be an AC or a DC motor, both of which are available from Motion Systems Corporation. The Motion Systems Model 85151/85152 actuator has been found to be particularly suitable for use in this invention. These devices have the AC or DC motor 1046 attached to a gear reducer 1048 for motor speed reduction to drive the ball drive actuator which is an epicyclic ball screw 1034, only the cover of which is shown. Or, a brushless DC motor may be provided. Although shown only schematically, a position sensor 1049 such as a potentiometer or optical sensor may be attached to the car frame by attachment to the reducer 1048 to a lip on the rear of the spring holder 1032 in order to measure the linear extension of the screw. Of course, other position sensors may be used as well.

The guide roller 1002 is journaled on an axle 1050 which is mounted in an adjustable receptor 1052 in the upper end of the link 1022. A pivot stop 1054 is mounted on a threaded rod 1056 which extends through a passage 1058 in the upper end 1060 of the pedestal 1024. The rod 1056 is screwed into a bore 1062 in the link 1022. The stop 1054 is operable by selective engagement with the pedestal 1024 to limit the extent of movement of the link 1022 in the counter-clockwise direction about the pin 1026, and therefore limit the extent of movement of the roller 1002 in a direction away from the rail, which direction is indicated by an arrow D. The pedestal 1024 is formed with a well 1064 containing a magnetic button 1066 which contains a rare earth compound. Samarium cobalt is a rare earth compound which may be used in the magnetic button 1066. A steel tube 1068 which contains a Hall effect detector (not shown) proximate its end 1070 is mounted in a passage which extends through the link 1022. The magnetic button 1066 and the Hall effect detector form a proximity sensor which is operably connected to a switch controlling power to the electric motor 1046. The proximity sensor detects the spacing between the magnetic button 1066 and the steel tube 1068, which distance mirrors the distance between the pivot stop 1054 and the pedestal 1024. Thus as the tube 1068 and its Hall effect detector move away from the magnet 1066, the pivot stop 1054 moves toward the pedestal 1024. The detector produces a signal proportional to the size of the gap between the detector and the magnetic button 1066, which signal is used to control the electric motor 1046 whereby the ball screw 1034 jack is caused to move the link 1022 and roller 1002 toward or away from the rail, as the case may be. Depending on the type of control system employed, the stop 1054 may be prevented from contacting or at least prevented from establishing prolonged contact with the pedestal 1024. This ensures that roller 1002 will continue to be damped by the spring 1030 and will not be grounded to the base plate 1008 by the stop 1054 and pedestal 1024. Side-to-side canting of the car by asymmetrical passenger loading or other direct car forces is also corrected. As mentioned, the electric motors 1046 can be reversible motors whereby adjustments on each side of the cab can be coordinated in both directions, both toward and away from the rails.

Figure 32:
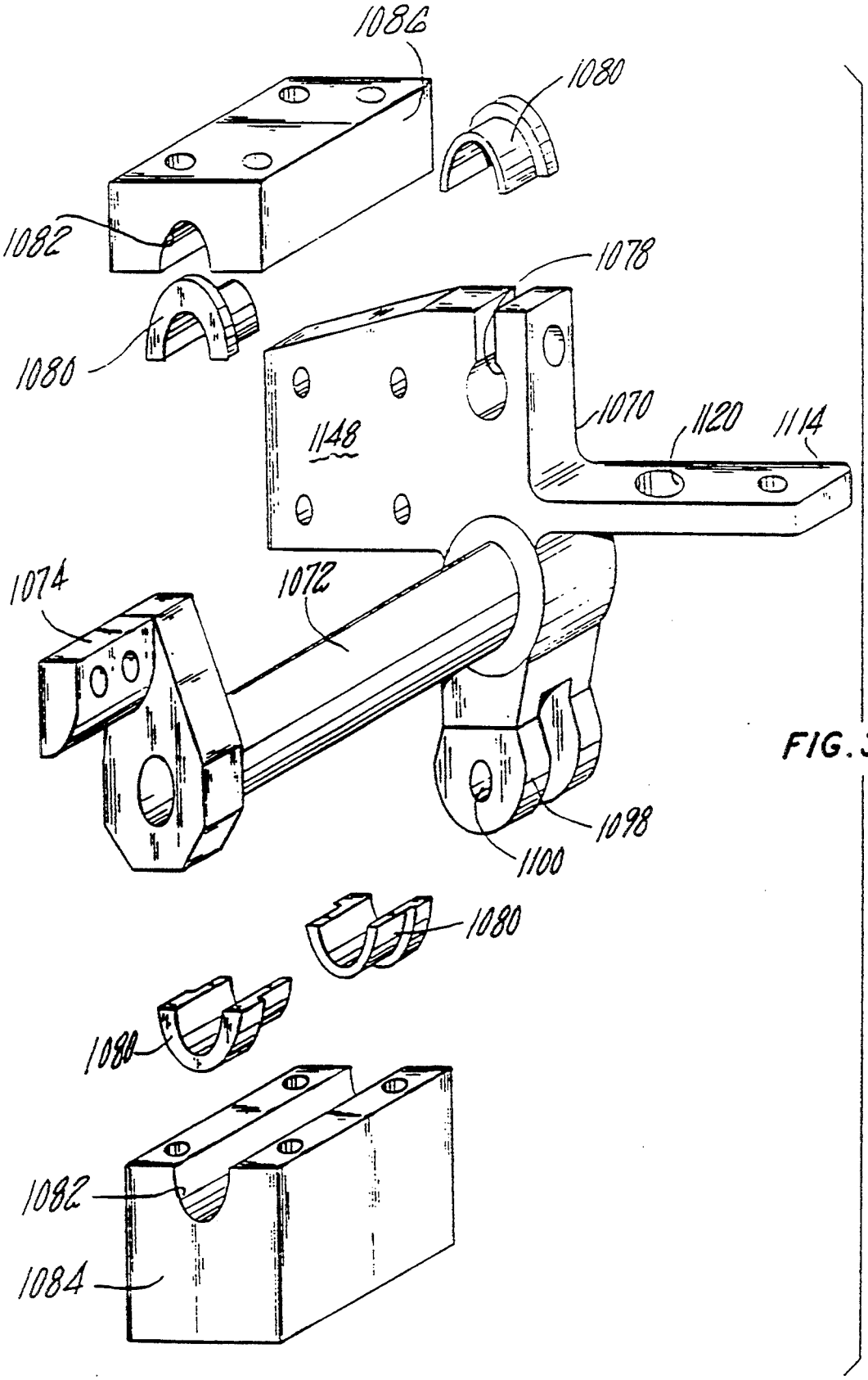
FIG. 32 is an exploded, schematic view of the front-to-back roller adjustment crank to which the spring of FIG. 33 is connected.
Figure 33:
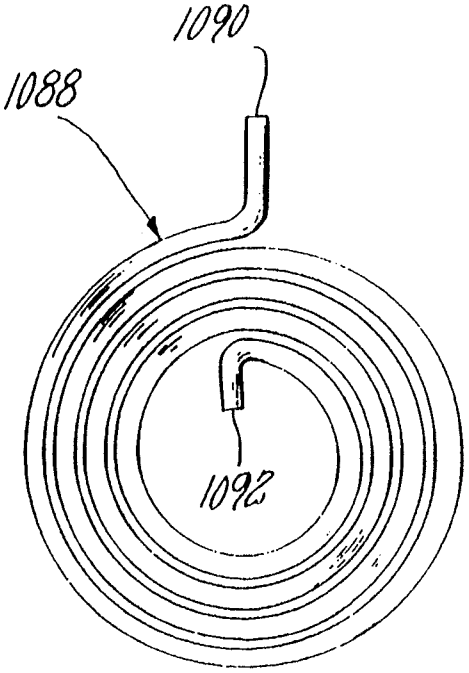
FIG. 33 is a plan view of the flat spiral spring used in the front-to-back guide for damping and adjusting the front and back rollers in the cluster.

Referring now to FIGS. 30, 31 and 32, the mounting of the front and back rollers 1004, 1006 on the base plate 1008 will be clarified. Each roller 1004, 1006 is mounted on a link 1070 connected to a pivot pin 1072 which carries a crank arm 1074 on the end thereof remote from the roller 1004, 1006. Axles 1076 of the rollers 1004, 1006 are mounted in adjustable recesses 1078 in the links 1070. The pivot pin 1072 is mounted in split bushings 1080 which are seated in grooves 1082 formed in a base block 1084 and a cover plate 1086 which are bolted together on the base plate 1008. A flat spiral spring 1088 (see FIG. 33) is mounted in a space 1089 (see FIG. 30) and has its outer end 1090 connected to the crank arm 1074, and its inner end 1092 connected to a rotatable collar (not shown) which is rotated by a gear train (not shown) mounted in a gear box 1094, which gear train is rotated in either direction by a reversible electric motor 1096. The spiral spring 1088 is the suspension spring for the roller 1006, and provides the spring bias force which urges the roller 1006 against the rail blade 1018. The spiral spring 1088, when rotated by the electric motor 1096 also provides the recovery impetus to the roller 1006 through crank arm 1074 and pivot pin 1072 to offset cab tilt in the front-to-back directions caused by front-to-back direct car forces such as asymmetrical passenger loading of the car.

A rotary position sensor (not shown) such as an RVDT, a rotary potentiometer or the like, may be provided for measuring the position of the actuator with respect to the car. Such sensor may be attached at one end to the crank arm 1074 and on the other to the base 1008.

Figure 34:
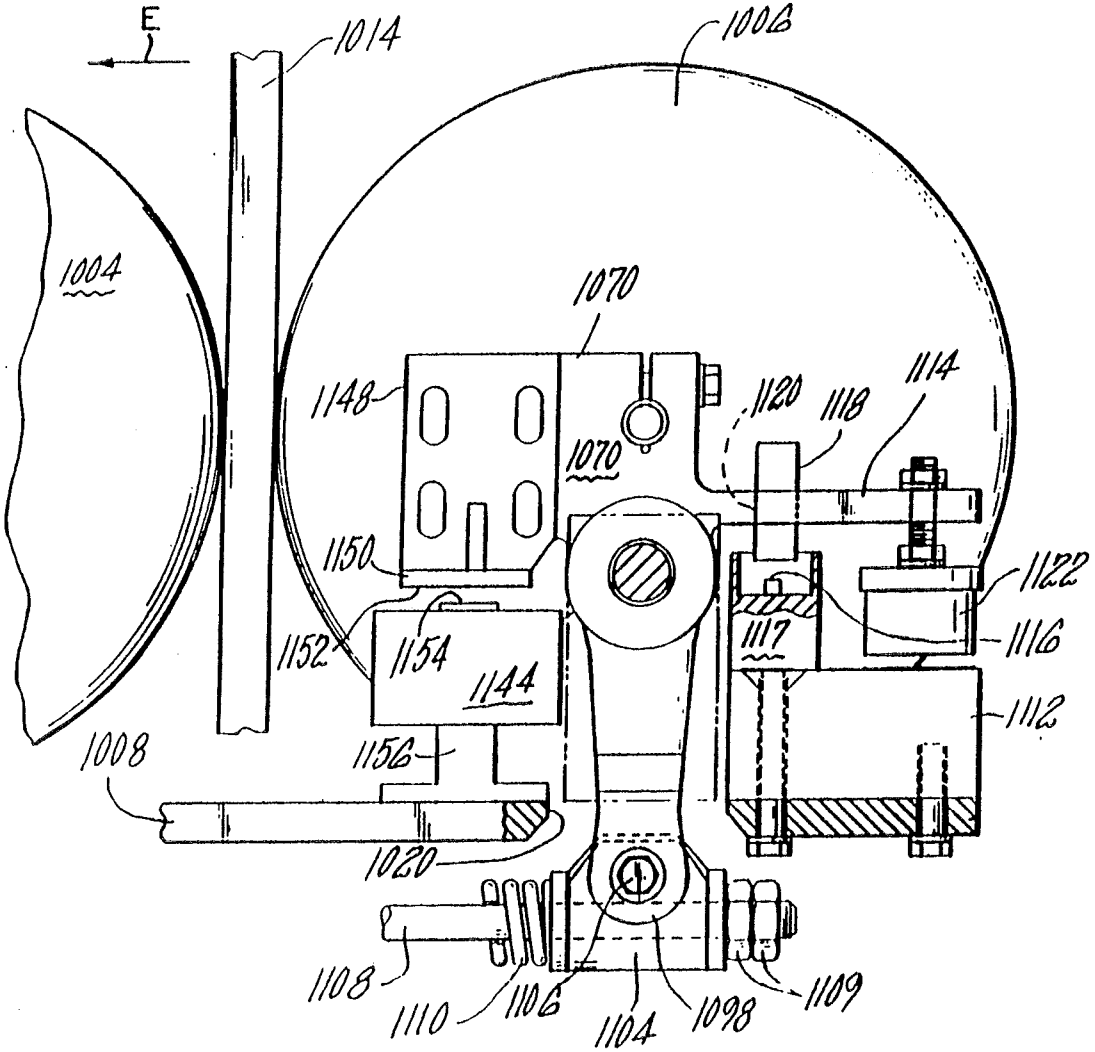
FIG. 34 is a front elevational view of the front and back guide rollers of the cluster.

Each roller 1004 and 1006 can be independently controlled, as shown below in FIG. 43, by respective electric motors and spiral springs if desired, or they can be mechanically interconnected and controlled by only one motor/spring set, as shown in FIGS. 30 and 34. Details of an operable interconnection for the rollers 1004 and 1006 are shown in FIG. 34. It will be noted in FIGS. 32 and 34 that the links 1070 have a downwardly extending clevis 1098 with bolt holes 1100 formed therein. The link clevis 1098 extends downwardly through a gap 1102 in the mounting plate 1008. A collar 1104 is connected to the clevis 1098 by a bolt 1106. A connecting rod 1108 is telescoped through the collar 1104, and secured thereto by a pair of nuts 1109 screwed onto threaded end parts of the rod 1108. A coil spring 1110 is mounted on the rod 1108 to bias the collar 1104, and thus the link 1070 in a counter-clockwise direction about the pivot pin 1072, as seen in FIG. 34. It will be understood that the opposite roller 1004 has an identical link and collar assembly connected to the other end of the rod 1108 and biased by the spring in the clockwise direction. It will be appreciated that movement of the link 1070 in clockwise direction caused by the electric motor 1096 will also result in movement of the opposite link in a counter-clockwise direction due to the connecting rod 1108. At the same time, the spring 1110 will allow both links to pivot in opposite directions if necessary due to discontinuities on the rail blade 1018. A flexible and soft ride thus results even with the two roller links tied together by a connecting rod.

As shown in FIG. 34, a stop and position sensor assembly similar to that previously described is mounted on the link 1070. A block 1112 is bolted to the base plate 1008 below an arm 1114 formed on the link 1070. A cup 1116 is fixed to the block 1112 and contains a magnetic button 1116 formed from a rare earth element such as samarium cobalt. A steel tube 1118 is mounted in a passage 1120 in the link arm 1114, the tube 1118 carrying a Hall effect detector in its lower end so as to complete the proximity sensor which monitors the position of the link 1070. A pivot stop 1122 is mounted on the end of the link arm 1114 opposite the block 1112 so as to limit the extent of possible pivotal movement of the link 1070 and roller 1006 away from the rail blade 1014. The distance between the pivot stop 1122 and block 1112 is proportional to the distance between the Hall effect detector and the magnetic button 1116. The Hall effect detector is used as a feedback signal operable to activate the electric motor 1096, for example, whenever the stop 1122 comes within a preset distance from the block 1112, whereupon the motor 1096 will pivot the link 1070 via the spiral spring 1088 to move the stop 1122 away from the block 1112 or, as another example, in a proportional, proportional-integral, or proportional-integral-derivative type feedback loop so that the position signal is compared to a reference and the difference therebetween is more or less continually zeroed by the loop. The position sensor 1049 of FIG. 31 may also be used to keep track of the position of the actuator with respect to the base 1008 as described below in connection with FIG. 43. In any event, this movement will push the roller 1006 against the rail blade 1014 and will, through the connecting rod 1108, pull the roller 1004 in the direction indicated by the arrow E, in FIG. 34. The concurrent shifting of the rollers 1004 and 1006 will tend to rectify any cant or tilting of the elevator cab in the front-to-back direction caused, for example, by asymmetrical passenger loading.

Figure 35:
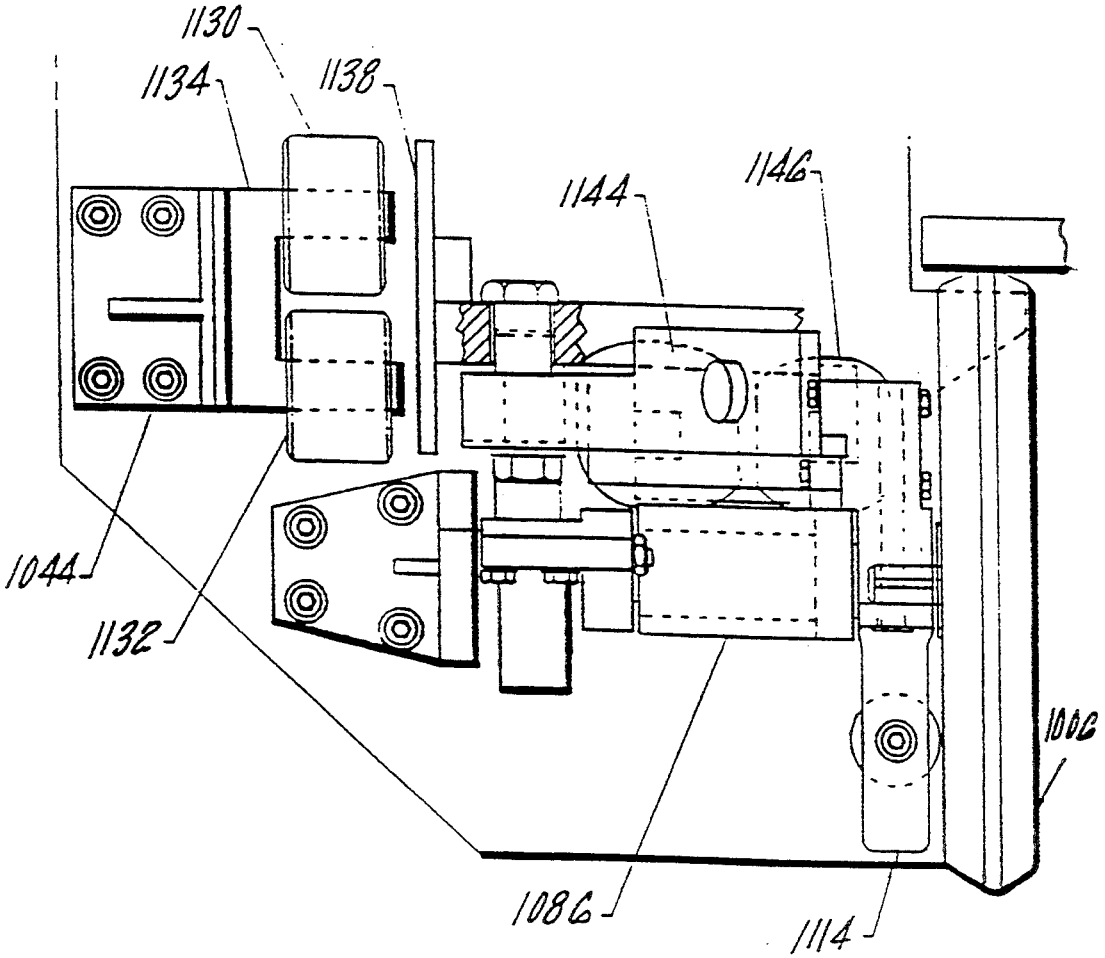
FIG. 35 is a partial plan view of a guide and one of the rollers of the guide rail cluster of the guide of FIG. 30 showing the positioning of the electromagnets of a relatively small-force actuator.

Referring now to FIGS. 30, 31 and 35, an electromagnet with coils 1130, 1132 is mounted on a U-shaped core 1134 which is in turn mounted on the bracket 1044. The bracket 1044 is itself mounted on the base plate 1008. As previously described, the shaft 1034 of the ball drive exerts forces along the axis of the ball screw against the pivoted link 1022. The link 1022 pivots at the point 1026 and extends down below the pivot point to the electromagnet coils 1130, 1132 and has a face 1138 separated from the core faces of the electromagnet core 1134 for receiving electromagnetic flux across a gap therebetween.

Figure 36:
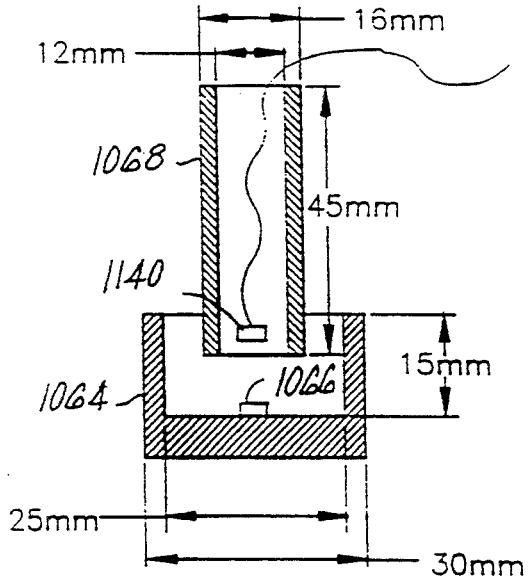
FIG. 36 shows a gap sensor which may be used to sense position, according to the present invention.

FIG. 36 is an illustration of the cup 1064, which should be of ferromagnetic material, with the rare earth magnet 1066 mounted therein. The depression in the cup may be 15 mm deep and have an inside diameter of 25 mm and an outside diameter of 30 mm, as shown, for example. The sleeve 1068 may have a length of 45 mm with an inside diameter of 12 mm and an outside diameter of 16 mm, for example. A hall cell 1140 is shown positioned near the opening of the tube 1068 so as to be in position to sense the flux from magnet 1066. The composition of the tube is ferromagnetic, according to the teachings of the present invention, in order to enhance the ability of the hall cell to sense the flux from the magnet and also to provide shielding from flux generated by the electromagnets mounted elsewhere on the roller guide.

| Specification for Position Transducers | |
|---|---|
| 1. Magnetic transducer may be used. | |
| 2. Operating Range: | 10 mm |
| 3. Repeatability: | 0.1 mm |
| 4. Temperature Range: | 0–55° C. |
| 5. Temperature Coef.: | <.02%/°C. |
| 6. Magnetic Field Sensitivity: | 100 Gauss at a distance of 30 mm should not affect transducer output by more than 0.5%. |
| 7. Power Voltage: | 9–15 VDC |
| 8. Leads: | Use separate signal and power grounds. Use twisted shielded pairs. |

Figure 37:
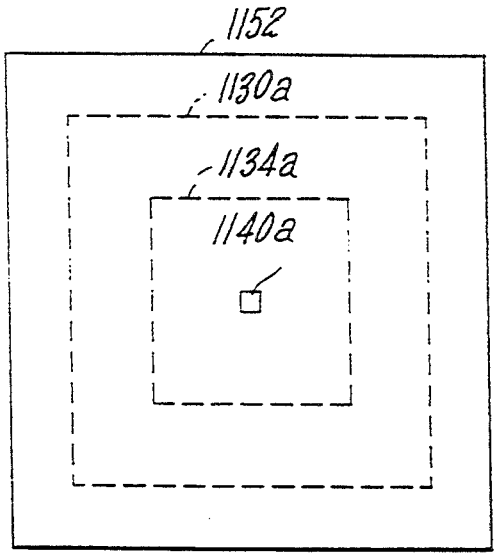
FIG. 37 shows a flux sensor which may be used in the acceleration loop of FIG. 43, according to the present invention.

FIG. 37 shows such a hall cell 1140*a* mounted on a face of the reaction plate 1138 with a projection 1134*a* of the electromagnet core 1134 onto the plate 1138 associated with coil 1130 (shown also in a projection 1130*a*) shown in FIGS. 30, 31 and 35. The sensor can also be mounted on the face of the core itself but could get overheated in that position.

| Specification for Hall Sensor Assembly | |
|---|---|
| 1. Application is on or opposite face of electromagnet. | |
| 2. Operating Range: | .05 to 1.0 Tesla |
| 3. Accuracy: | 5% tolerable, 2% desired |

-continued

| Specification for Hall Sensor Assembly | |
|---|---|
| 4. Scale Factor: | 10 V/Tesla |
| 5. Temperature Range: | 0–55° C. |
| 6. Temperature Coef.: | <.02%/°C. |
| 7. Thickness: | Must not exceed 2.0 mm |
| 8. Power Voltage: | ±12 to 15 VDC |
| 9. Leads: | Use separate signal and power grounds. Use twisted shielded pairs. |

Turning again now to the front-to-back roller 1006, a pair of electromagnets 1144, 1146 is shown in FIG. 31. A block 1148 portion of link 1070, shown in FIG. 32 in perspective and in FIG. 34 in section, has an extension 1150 shown in FIGS. 31 and 34 (not shown in FIG. 32) having a face 1152 opposite a pair of core faces associated with a core 1156 upon which coils 1144, 1146 are mounted, only one face 1154 of which is shown in FIG. 34.

Figure 38:
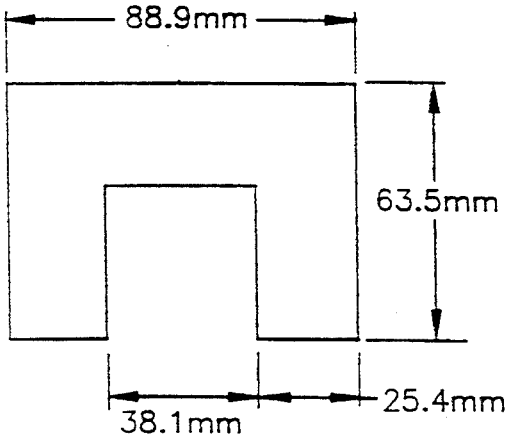
FIG. 38 shows a side view of an electromagnet core, according to the present invention.
Figure 39:
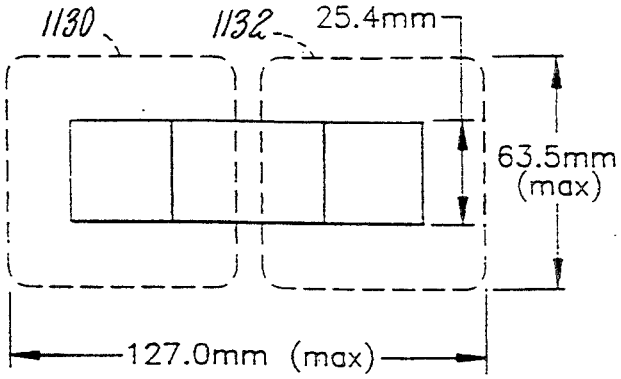
FIG. 39 shows a top view of the core of FIG. 38 with coils in phantom, according to the present invention.

FIG. 38 is a side view of a ferromagnetic core such as is used for mounting the coils 1130, 1132 of FIG. 30 or the coils 1144, 1146 of FIG. 31. The dimensions shown are in millimeters. FIG. 39 shows a top view of the same core with the depth dimensions shown along with a pair of coils shown in dashed lines. The core of FIGS. 38 and 39 may be made of grain-oriented (M6) 29 gauge steel, mounted on an angle iron by means of a weld, for example. The coils 1130, 1132, for example, will be required in pairs, each having, for example, 1050 turns of wire having a diameter of 1.15 mm. The coil connection should be series with the possibility made for parallel reconnection. The wire insulation can be heavy (double) build GP200 or equivalent rated at 200C. The impregnation can be vacuum-rated at 180C or higher. The coil working voltage may be on the order of around 250 volts and the coil itself may be high potential to ground tested at 2.5 kilovolts or similar, as required. The coil leads for hookup may be stranded wire, having a diameter of 1.29 mm, and about 50 centimeters in length. The weight is approximately 2.0 kilograms, consisting of 0.8 kg of iron and 1.2 kg of copper. At an air gap of 2–10 mm with a flux density of about 0.6 Tesla, a force of about two hundred Newtons can be achieved. Such a design is adequate for the active roller guide disclosed above. It has a force capability reserve of more than twice needed.

Figure 40:
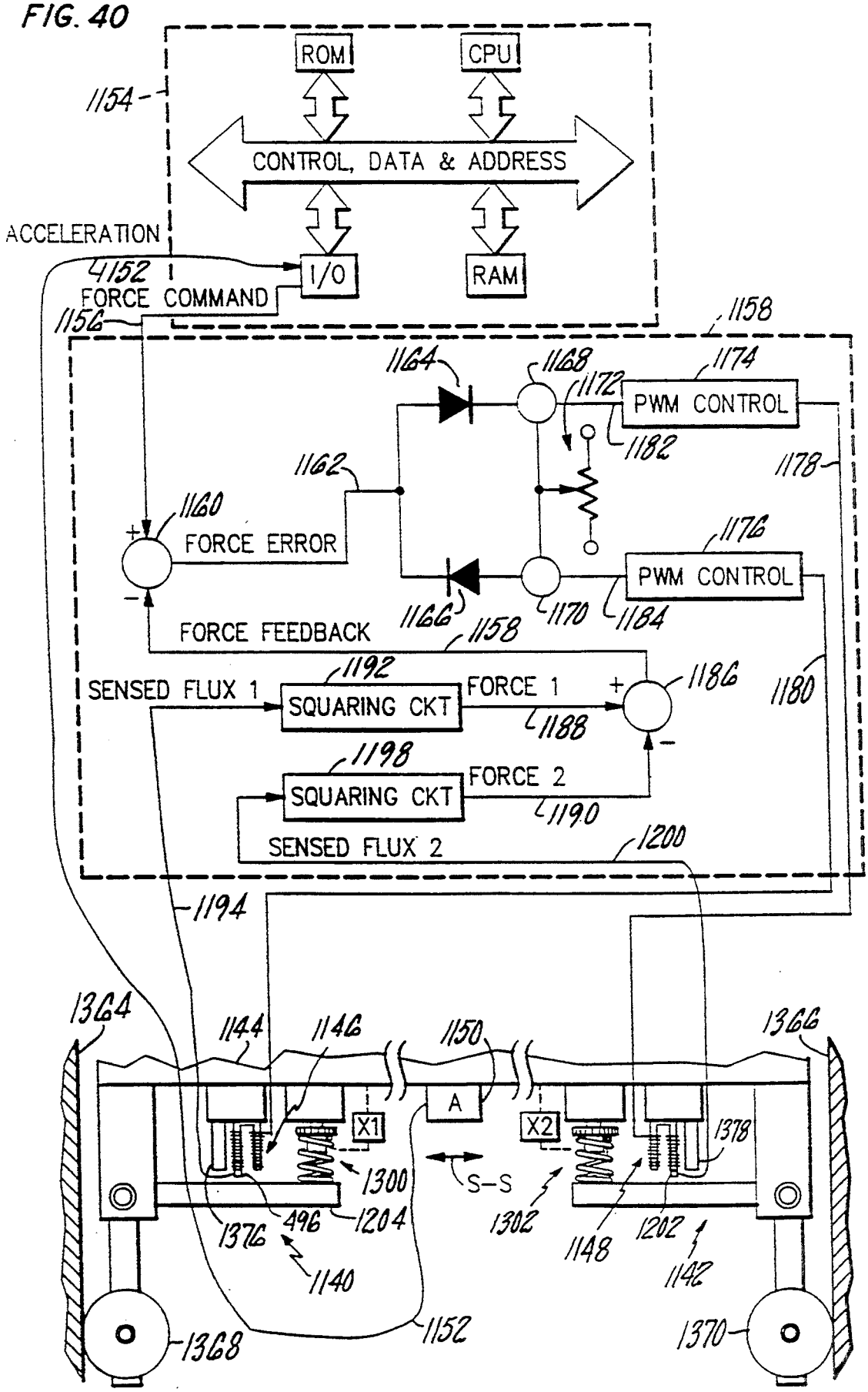
FIG. 40 is a simplified block diagram of a steering circuit for controlling two active guides situated on opposite sides of an elevator car for side-to-side control but which may be used for front-to-back control of guides on opposite sides of a rail blade.

FIG. 40 illustrates a pair of active roller guides 1140, 1142 mounted on the bottom of an elevator car 1144 for side-to-side control. FIG. 40 also illustrates a control for a corresponding pair of electromagnets 1146, 1148. Acceleration feedback is utilized in the described control circuit for the electromagnets, although other means of control may be used. Acceleration control will be described in detail in conjunction with position control of the high-force actuators in connection with FIG. 43. An accelerometer 1150 measures the side-to-side acceleration at the bottom of the platform, and it may be positioned inbetween the two active roller guides 1140, 1142. The direction of sensitivity of the accelerometer is shown by an arrow labeled S-S and would be perpendicular to the hoistway walls. A sensed signal on a line 1152 is provided to a signal processor 1154 which, in response thereto, provides a force command signal on a line 1156 to a second signal processor 1158 which may be made up of discrete components in order to provide faster response. The force command signal on line 1156 is summed with a force feedback signal on a line 1158 in a summer 1160 which provides a force error signal on a line 1162 to a steering circuit comprising a pair of diodes 1164, 1166. A positive force error signal will result in conduction through diode 1164 while a negative force error signal will result in conduction through diode 1166. In order to prevent abrupt turn-on and turn-off, action of the two electromagnets 1146, 1148 near the crossover between positive force response and negative force response as shown in FIG. 41, a bias voltage is provided to bias the left and right signals provided to the PWM controls. This is done by means of a pair of summers 1168, 1170 from a potentiometer 1172 which is biased with an appropriate voltage to provide the force summation technique illustrated in FIG. 41. This allows a smooth transition between the two electromagnets. A pair of pulse width modulated controls 1174, 1176 are responsive to summed signals from the summers 1168, 1170 and provide signals on lines 1178, 1180 having variable duty cycles according to the magnitudes of signals on line 1182, 1184 from the summers 1168, 1170, respectively.

The force feedback on line 1158 is provided from a summer 1186 responsive to a first force signal on a line 1188 and a second force signal on a line 1190. A squaring circuit 1192 is responsive to a sensed flux signal on a line 1194 from a Hall cell 1196 and provides the first force signal on line 1188 by squaring and scaling the flux signal on line 1194. Similarly, a squaring circuit 1198 is responsive to a sensed flux signal on a line 1200 from a Hall call 1202. The pair of Hall cells 1196, 1202 are mounted on or opposite one of the core faces of their respective electromagnets in order to be in a position to sense the flux between the electromagnet and the respective arms 1204, 1206 of the roller guides 1140, 1142.

The signal processor 1154 of FIG. 40 will be programmed to carry out the compensation described in detail in connection with FIGS. 18 and 24.

Figures 42, 42A:
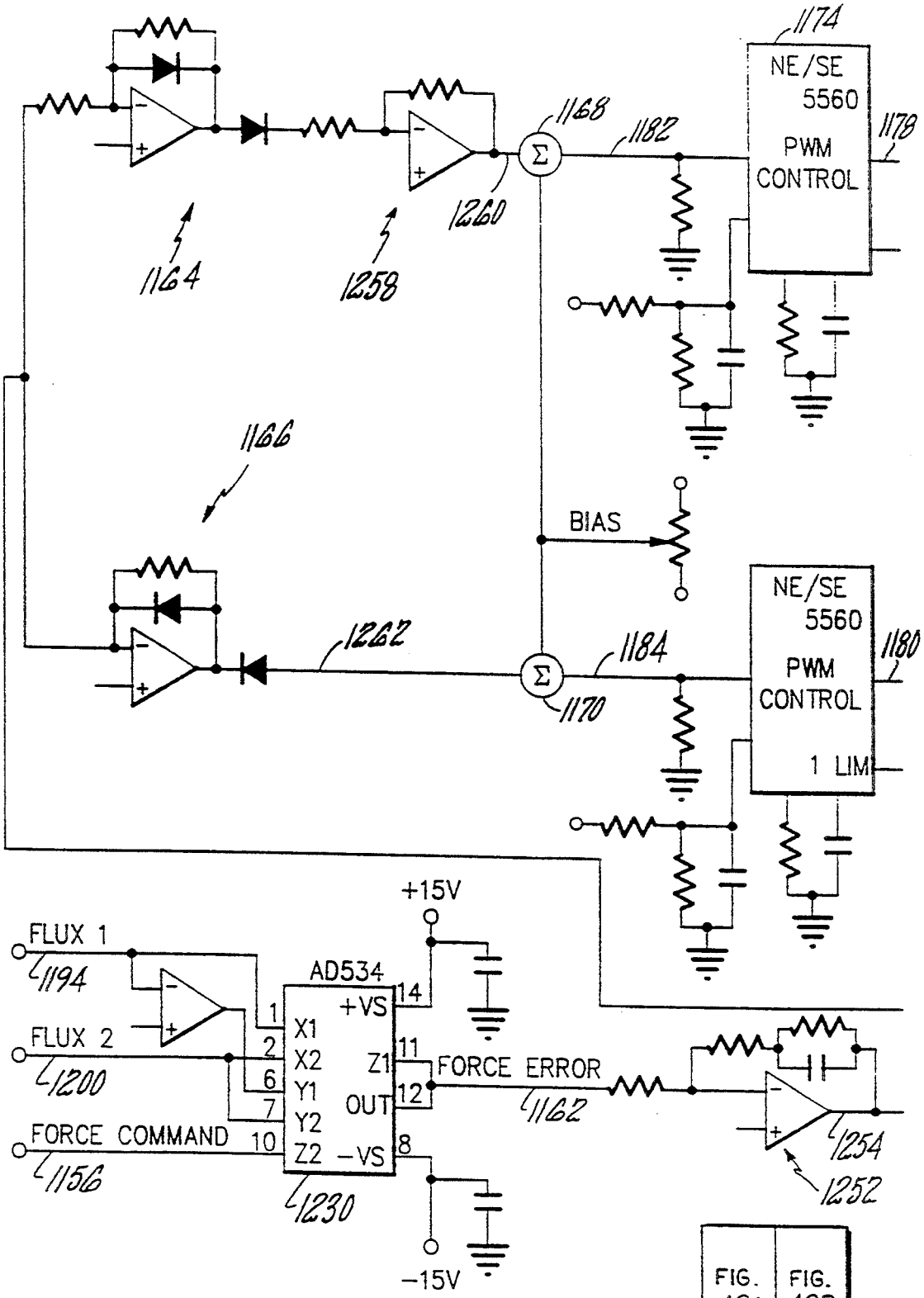
FIG. 42 is a more detailed illustration of the discrete signal processor of FIG. 40 and a composite overview of FIGS. 4*a* and 42*b*.
FIGS. 42*a* and 42*b* each illustrate a detailed schematic of the signal processor of FIG. 42
Figure 42B:
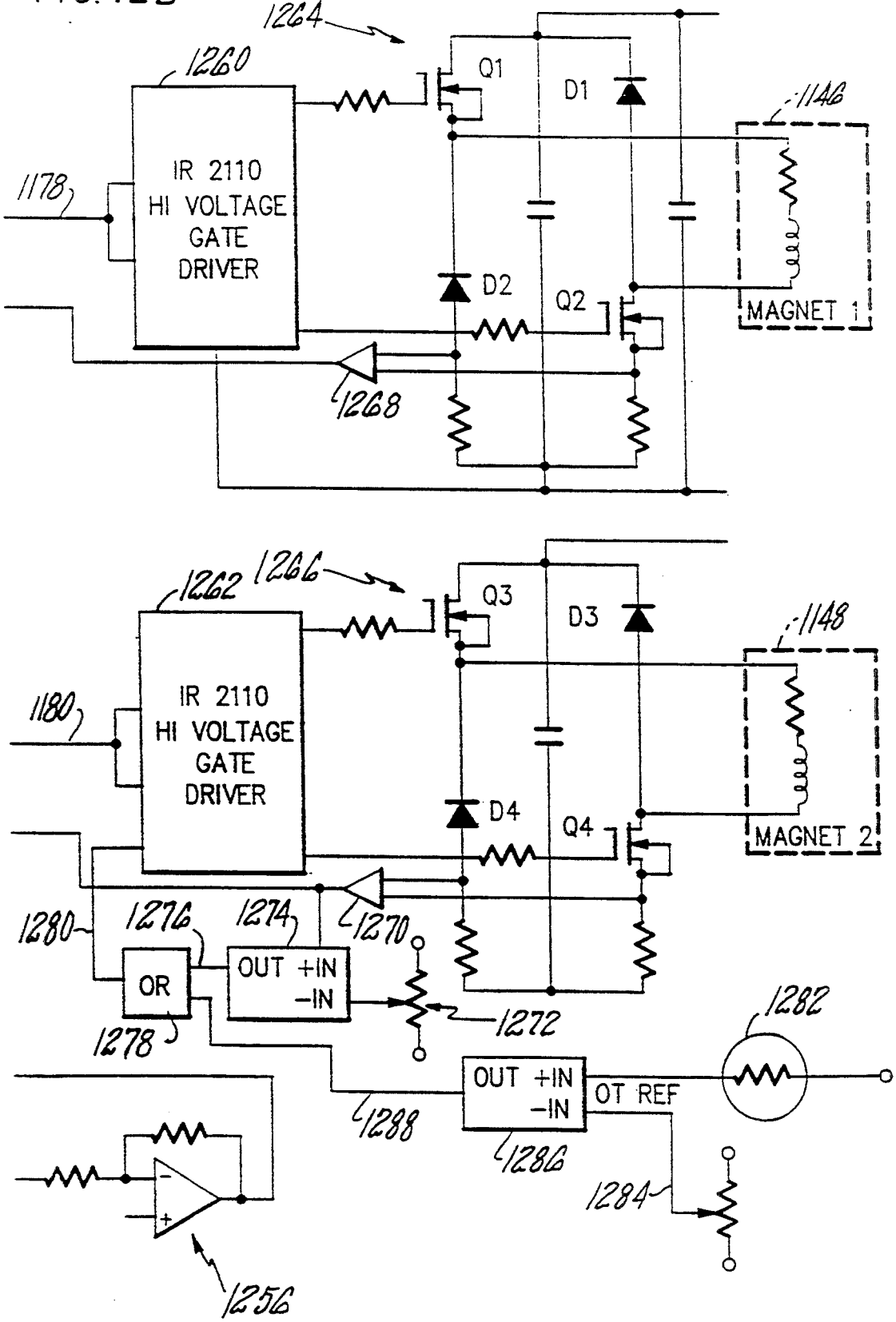

The signal processor 1158 of FIG. 40 is shown in more detail in FIG. 42. There, an integrated circuit 1230, which may be an Analog Device AD534, is responsive to the force command signal on line 1156, the first flux signal on line 1194, and the second flux signal on line 1200 and provides the force error signal on line 1162 as shown in FIG. 40. A PI controller 1252 amplifies the force error signal and provides an amplified signal on a line 1254 to a 100 volt per volt (gain of 100) circuit to the precision rectifier or diode steering circuits 1164, 1166, similar to that shown in simplified form in FIG. 40. An inverter 1258 inverts the output of steering circuit 1164 so that signals on lines 1260, 1262 applied to summers 1168, 1170 are of corresponding polarities. The summed signals on lines 1182, 1184 are provided to PWM controllers which may be a Signetics NE/SE 5560 type controllers. These provide variable duty cycle signals on the lines 1178, 1180, which are in turn provided to high voltage gate driver circuits 1260, 1262 which in turn provide gating signals for bridge circuits 1264, 1266 which provide current to the electromagnets 1146, 1148.

Amplifiers 1268, 1270 monitor the current in the bridge and provide a shutdown signal to the PWM controls 1174, 1176 in the presence of an overcurrent.

Also, a reference signal can be provided by a potentiometer 1272 to a comparator 1274 which compares the output of current sensor 1270 to the reference signal and provides an output signal on a line 1276 to an OR gate 1278 which provides the signal on line 1276 as a signal on a line 1280 to the high voltage gate driver 1262 in the case were the signal from the current sense 1270 exceeds the reference from reference potentiometer 1272. Also, a thermistor or thermocouple can be used on the heat sink of the circuit shown in order to be compared to an over-temperature reference signal on a line 1284 in a comparator 1286. The comparator 1286 will provide an output signal on a line 1288 to the 0R gate 1278 in cases where the temperature of the heat sink exceeds the over-temperature reference. In that case, the signal on the line 1280 is provided to the high voltage gate driver to shut down the H-bridge. Although most of the above-described protective circuitry of a current and over-temperature is not shown for the H-bridge for magnet number 1 (1146), it should be realized that the same can be equally provided for that bridge, but is not shown for purposes of simplifying the drawing.

Figure 43A:
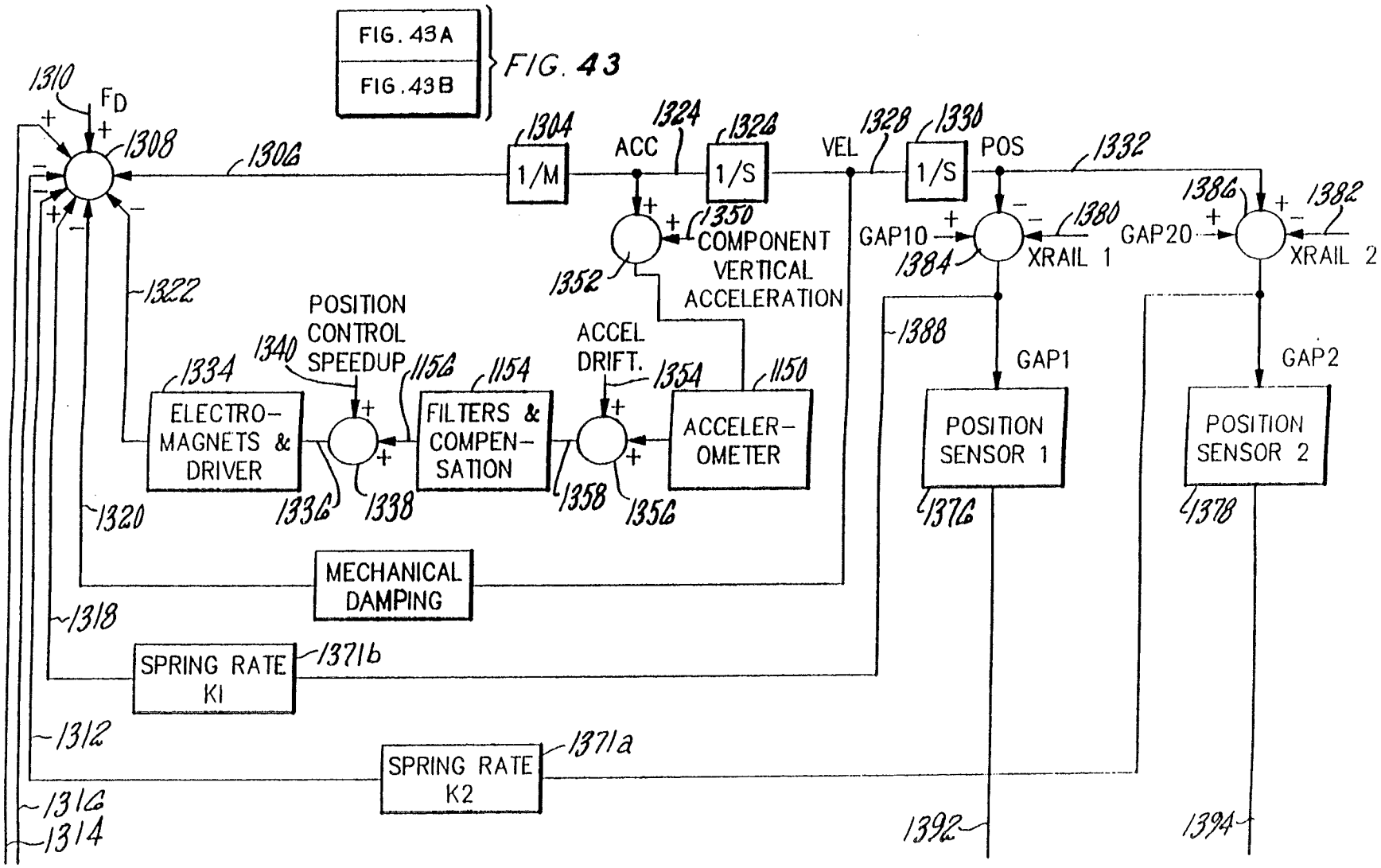
FIGS. 43*a* and 43*b* each illustrate a detailed schematic of the controls for the guides of FIG. 43.
Figure 43B:
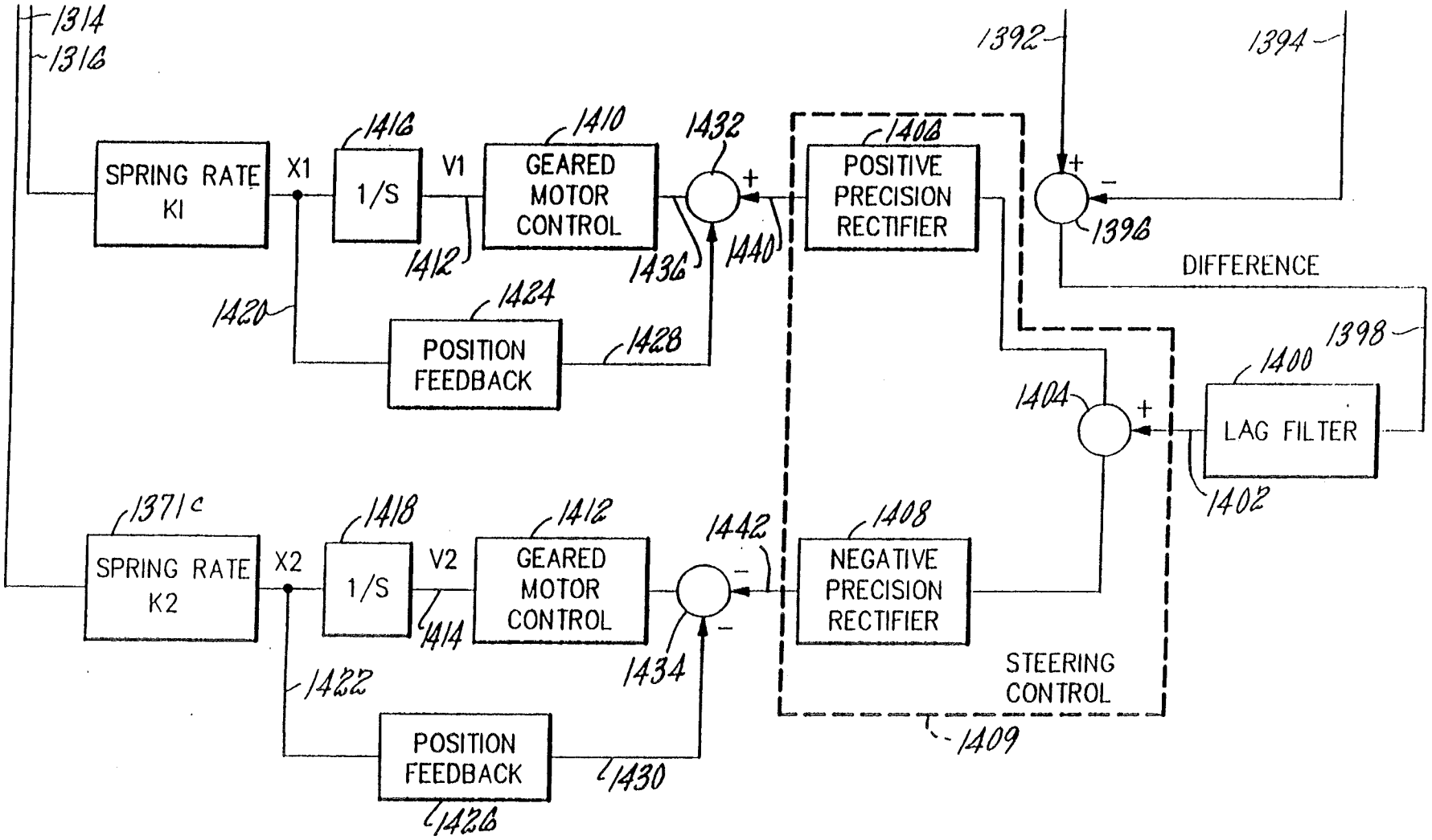

Turning now to FIG. 43, a system-level diagram is presented to show a control scheme for a pair of opposed guides such as the side-to-side active roller guides 1140, 1142 of FIG. 40. The diagram includes both acceleration feedback as described, for example, in detail above for the pair of small actuators 1146, 1148 and position feedback for a pair of high-force actuators such as the screw actuators 1300, 1302. It will be recalled that each roller 1004 and 1006 can be independently controlled, as shown below in Fig. 43, by respective electric motors and spiral springs if desired, or they can be mechanically interconnected and controlled by only one motor/spring set, as shown in FIGS. 30 and 34. It should therefore be understood that the scheme of FIG. 43 for independent control is, with slight modification as explained below, also applicable to opposed (on opposite sides of the same rail blade) guides that are linked, as in front-to-back suspensions linked in a way such as or equivalent to that shown in FIG. 34.

The elevator car mass 1304 is shown in FIG. 43 being acted on by a net force signal on line 1306 from a summer 1308 which is responsive to a disturbing force on a line 1310 and a plurality of forces represented on lines 1312, 1314, 13113, 1318, 1320, and 1322, all for summation in the summer 1308. The disturbing force on line 1310 may represent a plurality of disturbing forces, all represented on one line 1310. These disturbing forces may include direct car forces or rail-induced forces. The distinction between the two types of forces is that direct car forces tend to be higher force, but slower acting, such as wind, or even static, such as load imbalances, while rail-induced forces are low force disturbances at higher frequencies. The forces represented on lines 1312–1322 represent forces which counteract the disturbing forces represented on line 1310. In any event, the net force on line 1306 causes the elevator mass 1304 to accelerate as manifested by an acceleration as shown on a line 1324. The elevator system integrates the acceleration as indicated by an integrator 1326 which is manifested by the car moving at a certain velocity as indicated by a line 1328 which is in turn integrated by the elevator system as indicated by an integrator 1330 into a position change for the elevator car mass as indicated by a line 1332.

Both of the electromagnets 1146, 1148 and driver, as represented by the signal processor 1158 of FIG. 40, are together represented in FIG. 43 as a block 1334 responsive to a signal on a line 1336 from a summer 1338 which is in turn responsive to the force command signal on line 1156 from the digital signal processor 1154 of FIG. 40, represented in Fig. 43 as a "filters & compensation" block similarly numbered as 1154. This block carries out the compensation and filtering described in detail in connection with FIG. 18. A position control speed-up signal on a line 1340 may be provided from the gap error signal on line 1398. Suffice it to say that the speed-up signal may be used to permit the fast control to assist the slow control. Such assistance is also inherently provided by direct sensing by the accelerometer. The accelerometer 1150 of FIG. 40 is shown in FIG. 42 being responsive to the elevator car acceleration, as represented on line 1324 but as also corrupted by a vertical component of acceleration, as shown on a line 1350, being summed with the actual acceleration in a summer 1352. Thus, the side-to-side acceleration shown in FIG. 40 on the line labeled S-S may be corrupted by a small vertical component so that the signal on line 1152 is not a completely pure side-to-side acceleration. Similarly, the accelerometer is subject to drift, as shown on a signal line 1354 which may be represented as being summed with the output of the accelerometer 1150 in a summer 1356 to model a spurious acceleration signal. Finally, a sensed acceleration signal is provided on a line 1358 to the processor 1154. That finishes the description of the acceleration loop.

It will be appreciated that the two electromagnets 1146, 1148 of FIG. 40 do not present a problem of "opposition" or "fighting" each other because of the fact that control is steered between the two. For the case of two opposed, large size actuators, e.g., the two ball-screw actuators 1300, 1302, we have a similar problem in operating them independently since they may end up "fighting" each other. Now we shall present a concept for controlling the two high-force actuators 1300, 1302 of FIG. 40 by steering actuation to one or the other of the actuators.

The novel technique of developing a centering command signal and the steering of that signal to control two opposed actuators, as shown in FIG. 43, will be explained in conjunction with FIG. 44. Reference points are marked by zeros. A pair of elevator hoistway walls 1360, 1362 has a corresponding pair of rails 1364, 1366 attached thereto. Upon the surface of each rail a primary suspension, such as a roller 1368, 1370 rolls on a surface of the corresponding rail at a distance respectively labeled XRAIL2 and XRAIL1. A spring constant K2, shown in FIG. 43 as a block 1371*a*, acts between rollers 1368 and actuator 1300 while spring constant K1, shown in FIG. 43 as a block 1371*b*, acts between roller 1370 and actuator 1302. The position of the actuator 1300 with respect to the car 1304 is indicated by a distance X2 while the distance between the car 1304 and the centered position 1371 is indicated by a distance POS with positive to the right and negative to the left of center. The distance between the elevator car 1304 and the surface of the rail 1364 is indicated by a distance GAP2, and thus the distance between the actuator 1300 and the surface of the rail is GAP2−X2. GAP20 represents the distance between the hoistway wall 1360 and the car 1304 when the car is centered. Similar quantities are shown on the other side of the car.

Referring now back to FIG. 43, a position sensor similar to the sensor 1066, 1070 of FIG. 31 is shown as a block 1376 for measuring the distance GAP1 in FIG. 44. Similarly, a position sensor 1378 measures the quantity GAP2 of FIG. 44. It should be understood that although a pair of sensors 1376, 1378 are shown in FIGS. 40 and 43, such function of measuring the gaps (GAP1 and GAP2) may be carried out by a single sensor albeit without the self centering quality of the signal obtained by taking the difference between two GAP signals. It will be realized by examination of FIG. 43 that the measured quantities are related to the quantities shown in FIG. 44 by the following equations:

$$GAP1=-POS-XRAIL1+GAP10, \text{ and}$$

$$GAP2=-POS-XRAIL2+GAP20.$$

It will be noted that FIG. 43 is similar to FIG. 18 in many respects, except there are two position sensors 1376, 1378 responsive to the position (POS) of the cab, as indicated on the line 1332 and also the additional inner loops having position sensors for retracting the large actuators back to the home or zero position whenever not being actively used as an actuator. In FIG. 44, two gap position lines (GAP10 and GAP20) represent the distances between the car and the hoistway walls when the car is centered. These are further represented as "signals" being injected into "summers" 1384, 1386 in producing the physical gaps indicated as GAP1 and GAP2 lines 1388, 1390. These are useful for understanding the system.

Output signals from position sensors 1376, 1378 are provided on respective signal lines 1392, 1394 to a summer 1396 which takes the difference between the magnitudes of the two signals and provides a difference (centering control) signal on a line 1398 to a lag filter 1400 which provides a filtered centering control signal on a line 1402 to a junction 1404 which provides the filtered difference signal to each of a pair of precision rectifiers 1406, 1408 which together with the junction 1404 comprise a steering control 1409 for steering the filtered centering signal on a line 1402 to one or the other at a time, i.e., not both at the same time. A pair of geared motor controls 1410, 1412 is shown, one of which will respond to the steered centering command signal by moving at a relatively slow velocity as indicated on a line 1412 or 1414 as integrated by the system as indicated by integration blocks 1416 or 418 to an actuator position (X1 or X2) as indicated on a line 1420 or 1422 for actuating a spring rate 371*d* or 1371*c* for providing the force indicated by line 1316 or 1314. It should be realized that in this control system diagram, the spring rates 1371*b* and 1371*d* are associated with the same spring which is actuated by actuator 1410. Similarly, spring rates 1371*a* and 1371*c* are associated with the same spring, in this case actuated by actuator 1412. A pair of position feedback blocks 1420, 1422 are responsive to the actuator positions indicated by lines 1420, 1422 and include position sensors for providing feedback position signals on lines 1428, 1430 indicative of the position of the actuator with respect to the car. These position signals may be subjected to signal conditioning which may comprise providing a low gain feedback path. A pair of summers 1432, 1434 are responsive to the feedback signals on the lines 1428, 1430 and the centering command signal on line 1402 as steered by the steering control for providing difference signals on lines 1436, 1438 indicative of the difference therebetween. It should be understood that one signal of a pair of output signals on lines 1440, 1442 from the precision rectifiers 1406, 1408 will comprise the steered centering command signal on line 1402 and the other will be zero. By zero we mean a command having a magnitude equal to that required to cause the actuator to return to its zero position which will be that position required to maintain at least the desired preload on the primary suspension.

As mentioned, we can use many of the same concepts to control front to back centering by means of a pair of opposed but linked guides such as shown in FIGS. 30 & 34. Since there is no need for two actuators in such an arrangement, we simply sense the position of the car with respect to the roller (the "gap") and feed the sensed gap signal back to a gap feedback control loop that controls an actuator to maintain a desired gap.

Figure 45:
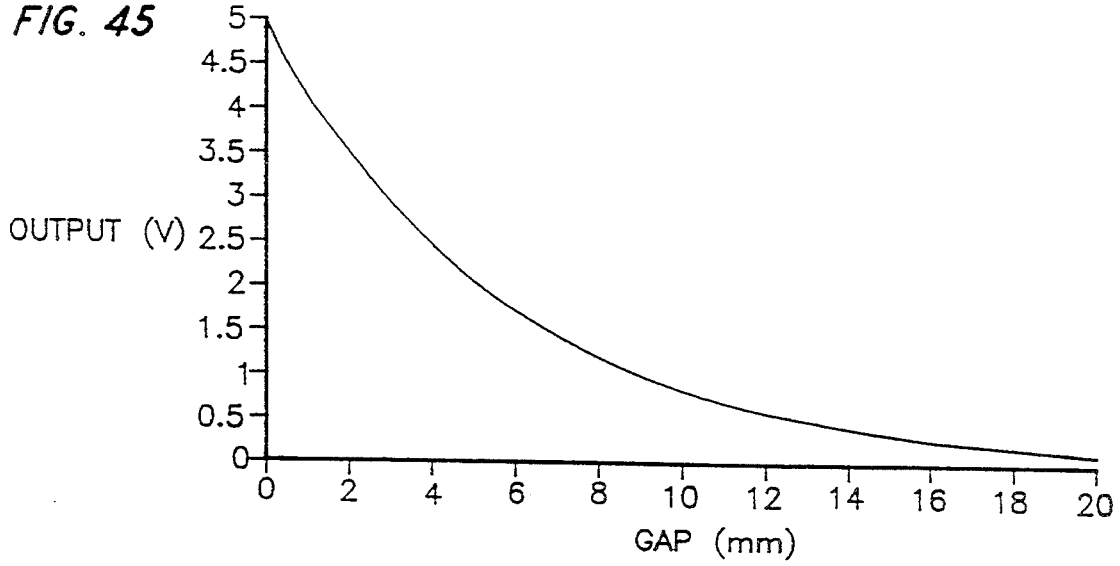
FIG. 45 is an illustration of the response of a single position transducer associated with, for example, each one of the position transducers such as illustrated in FIG. 36.
Figure 46:
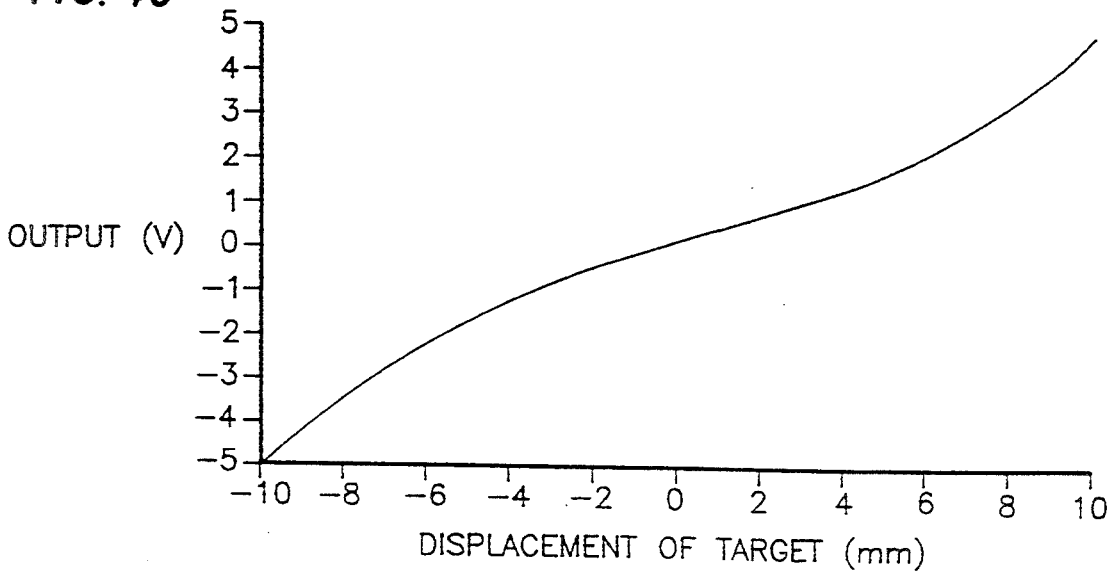
FIG. 46 is an illustration of a composite of two such transducer responses such as might appear on line 698 of FIG. 43.

Referring now to FIG. 45, the response of a position transducer, such as is shown in FIG. 62, is shown. This is an experimentally determined response. Although the response for a particular transducer is shown, it will be realized that any other suitable type of position sensor may be used, including linear position sensors. The summation of the two signals on the lines 1392, 1394 is shown in FIG. 44 over the whole range of displacement of the elevator car (scaled to the particular sensing arrangement we have shown). The positioning of the links on the active guides according to the embodiment shown is such that no more than ten millimeters of displacement is to be expected. Thus, it will be seen that the two position sensors for the corresponding two roller guides can be combined in a seamless response, such as shown in FIG. 46, for presentation to the lag filter 1400 of FIG. 43.

Figure 47:
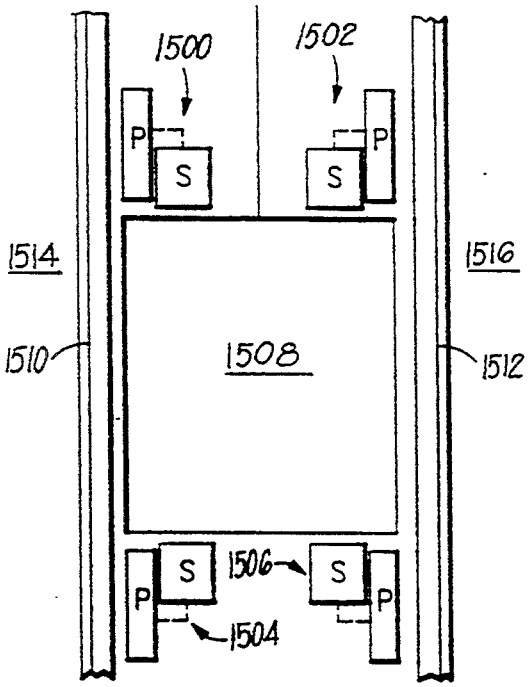
FIG. 47 is an illustration of an elevator car having a plurality of magnetic primary suspensions associated with secondary suspensions, according to the present invention.
Figure 49:
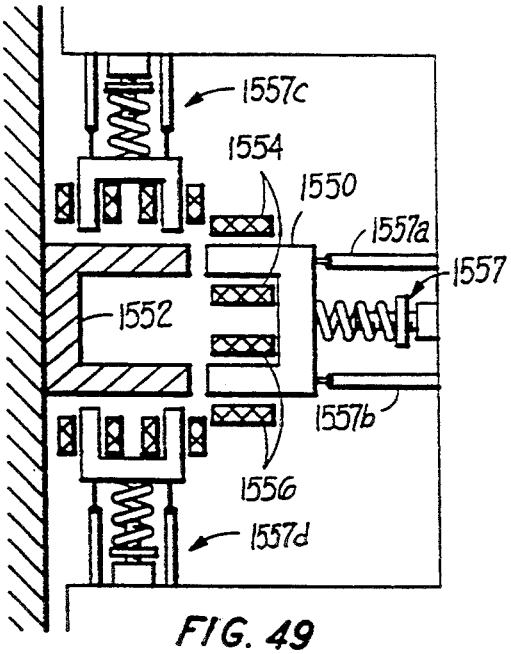
FIG. 49 is an illustration of a long core, such as shown in FIG. 48, oriented for interfacing with a C-shaped rail.

Referring now to FIG. 47, guides 1500, 1502, 1504, 1506 are shown for guiding a car 1508 between a pair of hoistway rails 1510, 1512 attached to hoistway walls 1514, 1516. Each of the guides has a primary suspension comprising an electromagnet labeled "P"and a secondary suspension labeled "S" to which the "P" primary is attached. The primary suspensions may appear as shown in FIG. 48 each with a core 1550 having a length considerably longer than its width which may be oriented with respect to a V or T-shaped rail in a manner similar to the orientation shown in FIG. 15, i.e., with the "C" shape oriented horizontally. This provides good, high-speed performance and more front-to-back guidance force than provided in previously disclosed electromagnetic actuators, such as shown in Kokoku, No. 58-39753 or Kokai 60-36279, which show or suggest rather short cores oriented ninety degrees from the orientation shown in FIG. 15, i.e., with the "C" shape oriented vertically. Regardless of the lengths or orientations of the cores, we teach that the primary suspension associated with the secondary suspension may be an electromagnet. As shown in FIG. 49, such a core 1550 may be oriented with respect to a C-shaped rail 1552 having a coil 1554 on one leg and a coil 1556 on another leg for providing flux for the flux path comprising the C-shaped rail 1550, the core 1552, and the gaps therebetween. The core 1550 is, of course, attached to a secondary suspension which is in turn attached to a car 1556*a*. In this case, we have shown a ball screw actuator 1557 for pushing on the core with a spring similar to the setup shown previously. In addition, we have shown a pair of stabilization guides 1557*a*, 1557*b*, which may be passive or active, e.g., solenoid operated. If active, they may be used in parallel with the actuator 1557 as an adjunct, to augment stability. Such a suspension would be used on the opposite hoistway rail as well for side-to-side stabilization. An additional pair of opposed front-to-back suspensions 1557*c*, 1557*d* are shown as well. Such would also be used in a similar manner on the opposite rail.

Figure 50:
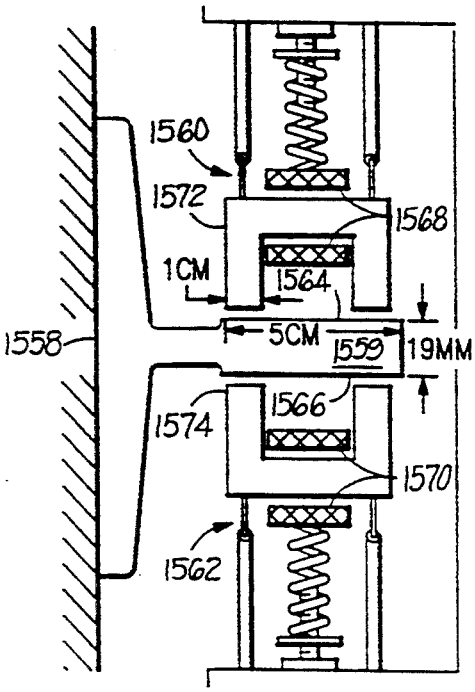
FIG. 50 is an illustration of a pair of long cores, such as shown in FIG. 48, for interface with a standard type rail.

For a more conventional shaped rail 1558, such as shown in FIG. 50, which may, for example, have a dimension of 19 mm for the distal surface of the blade which itself has a length of five centimeters, a pair of electromagnet actuators or electromagnet bearings 1560, 1562 are arranged opposite one another to face opposing surfaces 1564, 1566 of the blade 559. In this case, a pair of coils 1568, 1570 are wound around the piece that joins the two legs of the respective cores 1572, 1574. For this type of arrangement, the side-to-side control is provided by the natural reluctance of the electromagnets to move side-to-side.

One embodiment of the primary suspension shown in FIG. 50 uses core faces one centimeter wide. Assuming the cores themselves are shape like the core in FIG. 48 and have a length of 25 cm and a flux of 0.6 Tesla, the force per core is approximately 716 Newtons of attractive force. This is, of course, a front-to-back force, but the side-to-side force available is similar in magnitude without the need for additional electromagnets. If desired, one could use a third rail in the back of the car to help the side-to-side stabilization. A similar pair of cores would be used on that rail as well.

Thus, it will be observed that for the example given, the length of the core is five times longer than its width, although such should not be considered a limitation since this is merely an example, and the intent is to provide a teaching that shows a pole having a length significantly greater than its width. As previously mentioned, the type of electromagnet used is not essential, since various types of primary suspensions have been disclosed, not for the purpose of limitation but for the purpose of showing the wide applicability of the general concepts disclosed.

Similarly, the primary suspension may be a slide guide for running along guide rails such as shown in FIG. 2*a* and FIG. 2*b* of U.S. Pat. No. 4,750,590 where the guide shoes are laterally controllable using hydraulic cylinders mounted to the elevator car.

Figure 51:
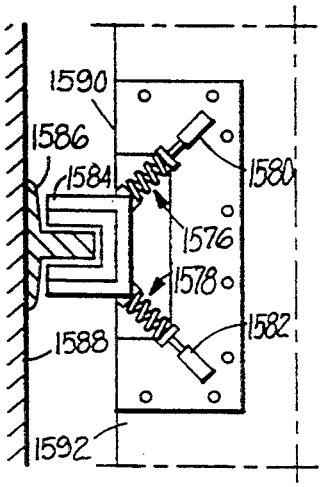
FIG. 51 is an illustration of a sliding guide shoe used as a primary suspension and interfaced with, for example, a plurality of hydraulic actuators.

FIG. 51 shows an alternate primary suspension comprising a guide shoe with actuators canted at 45 degrees, similar to Otala's actuators, as shown in U.S. Pat. No. 4,750,590, except having a pair of springs 1576, 1578 inserted inbetween the corresponding pair of hydraulic cylinders 1580, 1582 for actuating a guide shoe 1584 which rides on a guide rail 1586 mounted on a hoistway wall 1588. A base or carriage 1590 is mounted on an elevator car 1592. If the designer wishes to avoid the complexities introduced by using nonorthogonal force actuators and is willing to pay the added cost of an additional actuator per rail, he may used three actuators oriented orthogonally in a manner shown previously. For that case, it should be understood that the slide guide shoe 1584 may, but need not, comprise independent front-to-back and side-to-side shoes as opposed to the integral shoe shown.

Although the invention has been shown and described with respect to an exemplary embodiment thereof, it should be understood that the foregoing and other changes, omissions and additions may be made therein and thereto, without departing from the spirit and scope of the invention.

We claim:

1. An elevator cab assembly guidence system for guiding movement of a cab assembly over elevator guide rails in a hoistway, said guidence system comprising:

a) a guide roller assembly mounted on said cab assembly for movement toward and away from an associated one of the guide rails, said guide roller assembly comprising a guide roller mounted thereon for rolling engagement with the guide rail;

b) stop means operable to limit the extent of movement of said guide roller in a direction away from the guide rail; and c) adjustment means connected to said guide roller assembly and operable to prevent prolonged contact between said guide roller assembly and said stop means during operation of the elevator.

2. An elevator guide method for guiding an elevator car along a hoistway rail with horizontal motions controlled by means of an actuator, comprising the steps of:

sensing horizontal acceleration of the elevator car for providing a sensed acceleration signal;

sensing relative horizontal displacement between the car and the rail for providing a sensed displacement signal; and controlling the horizontal motions by means of said actuator in response to said sensed acceleration and displacement signals.

3. Apparatus for guiding an elevator car along a hoistway rail with controlled horizontal motions, comprising:

a controller, responsive to a sensed horizontal acceleration signal indictive of horizontal acceleration of the elevator car and responsive to a sensed horizontal displacement signal indicative of relative horizontal displacement between the elevator car and the rail, for providing a control signal; and an actuator, responsive to the control signal, for controlling the horizontal motions.

4. The apparatus of claim 3 wherein said actuator comprises:

a) a guide roller assembly mounted on said elevator car for movement toward and away from said hoistway rail, said guide roller assembly comprising a guide roller mounted thereon for rolling engagement with the hoistway rail;

b) stop means operable to limit the extent of movement of said guide roller in a direction away from the hoistway rail; and c) adjustment means connected to said guide roller assembly and operable to prevent prolonged contact between said guide roller assembly and said stop means during operation of the elevator car.

5. The apparatus of claim 3, wherein said actuator comprises:

a base for attachment to the elevator car;

three wheels, one for rolling on a distal end of a blade of said rail and two for rolling on opposing sides of said blade; and actuator means attached to the base and the three wheels.

* * * * *